US006083066A

United States Patent [19]

Wright

[11] Patent Number: 6,083,066

[45] Date of Patent: Jul. 4, 2000

[54] ROWING APPARATUS

[76] Inventor: Terry Ellwood Wright, 2744 Spring Hill Rd., Secane, Pa. 19018

[21] Appl. No.: 09/240,873

[22] Filed: Feb. 1, 1999

Related U.S. Application Data

[66] Substitute for application No. 09/094,654, Jun. 15, 1998, abandoned.

[51] Int. Cl.[7] ..... B63H 16/04

[52] U.S. Cl. ..... 440/102

[58] Field of Search ..... 440/101–106; 416/74

[56] References Cited

U.S. PATENT DOCUMENTS

| | | | |
|---|---|---|---|
| 284,984 | 9/1883 | Schunk | 440/102 |
| 535,584 | 3/1895 | Harbers | 440/103 |
| 718,156 | 1/1903 | Putman | 440/103 |
| 788,884 | 5/1905 | Buff | 440/102 |
| 808,720 | 1/1906 | Buff | 440/102 |
| 1,345,860 | 7/1920 | Kohl | 440/103 |
| 2,033,637 | 3/1936 | Kaiser | 440/102 |
| 3,857,356 | 12/1974 | Jewett | 440/104 |
| 5,037,339 | 8/1991 | Smith | 440/102 |

FOREIGN PATENT DOCUMENTS

| | | | |
|---|---|---|---|
| 72705 | of 1893 | Germany | 440/102 |
| 649464 | of 1937 | Germany | 440/102 |

OTHER PUBLICATIONS

Canoe & Kayak Magazine, Mar. 1997, p. 35 (canoe rowing attachment).

Paddler Magazine, Jul./Aug. 1998, p. 74 (raft oars).

*Primary Examiner*—Jesus D. Sotelo

[57] ABSTRACT

A rowing apparatus which allows an oarsman to face forward while propelling a watercraft such as a canoe (20) forward when pulling on handles (32). The articulated apparatus includes two sheaves coupled by a pair of criss-crossing, adjustable cables enclosed within a housing (24). A detachable, obtuse-angle shaped handle (32) attaches to a handle lever (34), which attaches to an upper side of one of the sheaves. An under side of the other sheave attaches to an oar blade lever (38), which extends to an oar blade (40). Each sheave has an axle (120) supported at its extremities by housing (24) and a canopy (26). A canopy cover (28) encloses each canopy (26), fastens to each axle (120), and rotates with its respective lever (34) or (38). A pair of outriggers (30A) and (30B) pivotally support housing (24) at an outboard location and attach to a pair of thwarts (46) and (48). A pair of webbing straps (50) form an "X" brace between thwarts (46) and (48). Mounting pads (54), which attach with an adhesive to the upper surface of gunwales (22), accept anti-slip pins (56) projecting from the bottom side of thwarts (46) and (48). Counterbalance springs (182A) and (182B) compensate for imbalance of the design and overhang of blade (40). The arrangement of springs (182A) and (182B) provide a reduction of lifting pressure to blade (40) when in a submerged position. An oar blade float (42) attaches to an upper portion of blade (40), preventing it from dropping excessively below the water surface. Float (42) has a hinged attachment allowing it to drop to a lower position for reducing aerodynamic drag during the recovery stroke. A variation of an oar blade (shown in FIGS. 15*a* to 15*d*) includes a spring-loaded pivotal blade with a float which automatically feathers when removed from water. This variation includes a float with a surface for hydroplaning during the recovery stroke. Serving as a bumper, a triangular flaglike structure herein described as a pennant bumper (44), attaches to housing (24) and gunwale (22) forward of housing (24).

24 Claims, 15 Drawing Sheets

72
104
90
88
92
88
96
94
106
70
30B
98
106
114
126B
120
38
26
110
114
114
24
112
108
26
114
126A
78
86
34
186
114
72
74
80
120
116
34
72
70
30A
86
78
82
118
114

FIG. 13a
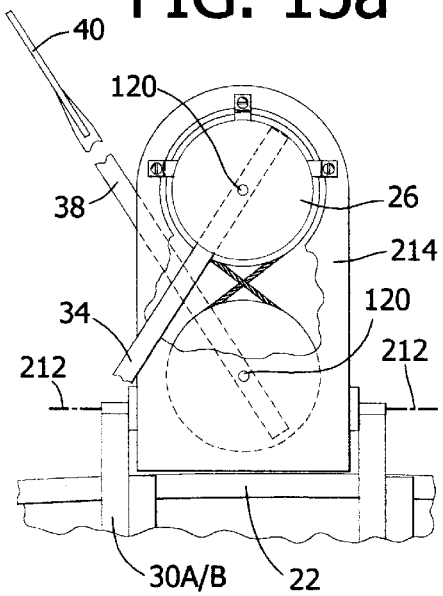
FIG. 13b
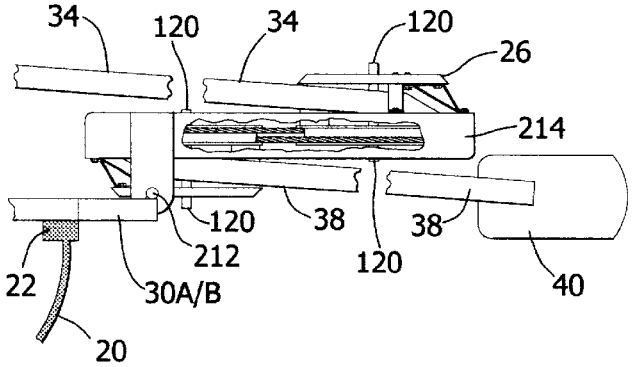
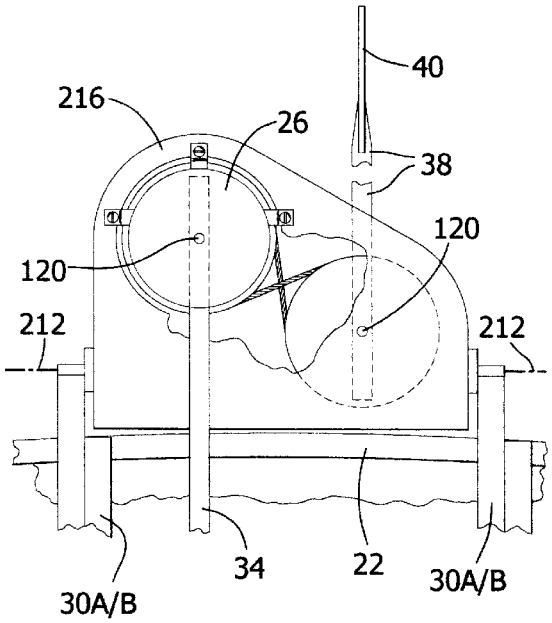
FIG. 13c
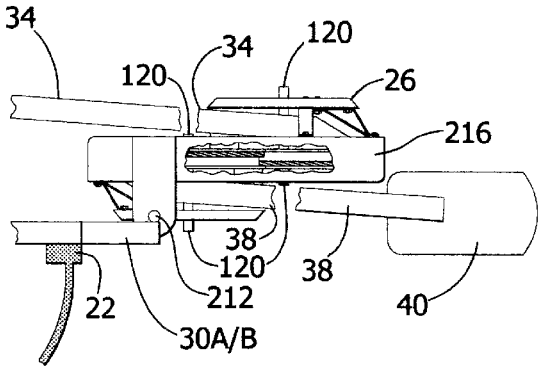
FIG. 13d

ROWING APPARATUS

This is a substitute application for application Ser. No. 09/094,654 originally filed Jun. 15, 1998 entitled Apparatus for Forward Facing Rowing, now abandoned.

BACKGROUND-FIELD OF INVENTION

This invention relates to the class of rowing apparatus which allows an oarsman to face in the direction the boat is propelled.

BACKGROUND-DESCRIPTION OF PRIOR ART

Throughout the years a large quantity of prior art has been presented with names such as bow facing oars, articulated oars, forward facing rowing mechanisms, oar reversing devices, and the like. All are devices permitting an oarsman to face forward while propelling a rowboat, canoe, or similar watercraft forward when pulling on handles.

Nevertheless all prior art suffer from a number of disadvantages. First of all, most articulated designs will exert a heavy twisting pressure to a hull when operated. This twisting pressure generally corresponds in direction and rotation with the stroke arc of the handle. If the apparatus mounts to a non-rigid watercraft such as a canoe, this pressure should be addressed to prevent flexing of the hull.

To be feasible, an apparatus must also be capable of withstanding relatively high mechanical loads without breaking or distorting excessively. An oarsman can exert more than a hundred foot pounds of pressure on the apparatus when pulling on the handle. Many prior art designs can only be constructed or modified to withstand this pressure by increasing size and weight. This increase in size and weight would result in a large, heavy, and therefore undesirable apparatus.

One of the major problems of most prior art designs is poor axial support. In other words, these designs have a component such as a sheave, sprocket, or gear with an axle coinciding with its axis. A frame supports only one end of this axle. This can result in flexing or bending of the axle if the axle has a small diameter. In addition, the frame can also flex or bend excessively if not exceedingly rigid. These axle and frame failures can occur due to the extended overhang of the oar blade, as well as heavy torsional loads. Only an undesirable increase in size and weight of the axle and frame can reduce these problems in these designs.

Another disadvantage of most prior art designs is that most are not capable of 180° of rotation or stroke. Most are capable of less stroke due to design limitation, or specifically, interference of its members. Because of this, they possess a reduced ability to retract when not in use. Most which can fully retract with an oar blade extending rearward cannot fully retract with the blade extending forward. The ability to retract in both directions allows both the oarsman and passengers easier entry and exit of the watercraft when the apparatus is retracted.

Almost all previous designs are capable of inflicting serious personal injury. This is because one can accidentally place fingers between meshing gears or other closing parts. In some cases a simple guard can prevent this. In many cases however, this is not practical or possible because a guard would restrict the movement of the apparatus.

Designs having a handle lever pivot and an oar blade lever pivot arranged inboard and outboard respectively, are less desirable for a watercraft with a narrow beam such as a canoe. In these designs, handle length usually must be reduced excessively to prevent one handle from interfering with the opposite handle. In this respect, tandem designs (having these pivots arranged one forward of the other) are usually better suited for canoes.

Other notes to be made regarding designs having levers, gears, sprockets, and sheaves include the following:

Levers do not transfer an oarsman's energy efficiently throughout a wide angle of stroke (due to reduction of mechanical advantage). Levers are not capable of 180° of stroke.

Gears in practice have backlash or clearance between teeth. Gears do not inherently absorb the reciprocating shock of the rowing strokes as does a cable. Also, to maintain tooth clearance within acceptable limits over varying loads, gears require a frame with higher rigidity than a frame having cable drive. Improper tooth clearance can result in excessive backlash or binding.

Chains and belts are viable alternatives to cables, but these systems are generally more complicated or heavier.

Looking back through history at selected prior art, U.S. Pat. No. 284,984 to H. Schunk (1883) discloses a design with good axial support and capable of 180° of stroke. However, for a canoe with a narrow beam, each handle would be limited to a short undesirable length to prevent one handle from interfering with the other.

U.S. Pat. No. 535,584 to F. Harbers (1895) shows a design employing a chain. This design, having a frame occupying a large inboard area of a boat, limits handle length significantly. For the same reason, Harber's design is not desirable for narrow canoes. Additionally, a chain guard is necessary to reduce the possibility of personal injury. Furthermore, the frame does not support one end of each sprocket axle. This can result in a bent axle or frame due to the heavy mechanical loads and the extended overhang of the oar blade.

A U.S. Pat. No. 718,156 issued to D.C. Putnam (1903) comprises a tandem gear design better suited for a canoe. Although Putnam's design has a frame supporting opposite axle ends of each gear, the narrow frame as shown is not rigid. Without a guard the gears can cause severe personal injury. Also, this design is not capable of 180° of stroke.

U.S. Pat. Nos. 788,884 (1905) and 808,720 (1906) both to F. L. Buff are tandem designs utilizing cables crisscrossing between two sheaves. Like Putnam's design, Buff's tandem design allows a longer handle length, but with less than 180° of stroke. In Buff's design, a tie bar described as a brace plate, ties one end of each sheave axle together. This tie bar only controls the distance between the axles. Twisting and side to side movement of the axle ends still remain unchecked.

U.S. Pat. No. 1,345,860 to F. Kohl (1920) is a design having bevel gears with a center shaft described as a standard. This gear design is capable of 360° of rotation, but possesses various disadvantages. Being a gear design, the teeth of the gears are subject to the shock of the reciprocating stroke motion. Tooth wear and breakage can be a major problem. Proper clearance between teeth is difficult to maintain when pulling on the handle. This is due to flexing or movement of members of the apparatus when under load. The standard, especially as shown, can twist and bend excessively, causing this clearance problem.

Lastly, German patent 649464 class 65c group 11 (1937) to Arthur Gaunitz discloses a tandem gear design capable of 180° of rotation. This design possesses improved axial support due to the fact it provides a bearing on both sides of each gear. Although having better support than designs such as Harber's chain design, designs such as Schunk's 1883 design with axles supported at both opposite ends have the best axial support. Frames that do not support axles at both opposite ends must have exceedingly rigid construction to withstand the loads applied by the oarsman. In Gaunitz's design, levers attaching to the handle and oar blade do not directly attach to the gears. These levers attach to axles which in turn attach to the gears. This means that the axle must be of sufficient diameter to transfer the heavy torque to the gear without twisting and breaking. Because of the high torque, maintaining rigid attachment between lever and gear can be a problem. Because of the extended overhang of the oar blade and less than optimum axial support, bending of the axles can occur. If dimensions were increased sufficiently to withstand the loads, various disadvantages would remain. To accept an axle which will not bend and is capable of transferring the heavy torque, the bearings between the gears and levers would require a relatively large internal diameter. The bearings must also withstand heavier loads than bearings in designs supporting axles at their extremities. This translates to more costly bearings and a heavier mechanism. Additionally, a design with increased dimensions and weight would possess an overboard imbalance. This would require extra downward pressure on the handles to raise the oar blades.

OBJECTS AND ADVANTAGES

Accordingly, various objects and advantages of my present apparatus for forward facing rowing are:

(a) to provide rigid axial support to sheaves, sprockets, or gears with minimal weight gain, preventing distortion of frame and axles;

(b) to provide 180° of stroke for full retraction of the oar blades in both forward and rearward positions, so as not to impede getting in and out of the boat when retracted;

(c) to provide excellent shock absorption of the reciprocating stroke;

(d) to provide a cable adjustment disposed between the periphery and axis of a sheave, allowing more adjustment without interference of the 180° of stroke or rotation;

(e) to provide a band along the bed of a peripheral groove of each sheave for the reduction of wear, while eliminating a cable guiding rib between cables in each sheave;

(f) to provide an enclosure, covering closing parts which can cause personal injury to fingers;

(g) to provide a frame which does not occupy inboard space, allowing longer handle levers;

(h) to provide a frame with a pivot location which requires reduced vertical movement of the handle to lift the oar blade out of water;

(i) to provide a design that if one oar blade is retracted without the other, an excessive unbalanced situation of the boat does not occur, a very desirable feature for unstable canoes;

(j) to provide an elongated frame relative to the longitudinal axis of the boat (in this form, the frame can better adapt to a mount that can effectively control the twisting pressures previously mentioned);

(k) to provide a pair of thwarts as part of the apparatus, adapted to mount to the boat to prevent the flexing of the hull caused by the twisting force;

(l) to provide diagonal braces attaching to both aforementioned thwarts, for controlling or maintaining the distance between a starboard side end of one thwart and a port side end of the other thwart;

(m) to provide a non-slipping mounting means for the apparatus, adaptable to various upper surface slopes of gunwales, where the apparatus can be rapidly attached to a predetermined position;

(n) to provide handles which prevent the oarsman's hands from striking thwarts, while imparting a more comfortable position to the wrists;

(o) to provide a means for correcting an unbalanced condition of the oar blade to handle, so that minimum pressure is required to raise and maintain the oar blade out of water;

(p) to provide a means to correct the aforementioned unbalanced condition in such a way that the oar blade can drop rapidly in the water when released, to a completely submerged, limited depth;

(q) to provide increased stability to a boat when applying downward pressure to the oar blades in water;

(r) to provide a means to reduce aerodynamic drag of the oar blade during the recovery (forward return) stroke;

(s) to provide a means to automatically feather the oar blade when not submerged in water;

(t) to provide a means for a feathering blade to "hydroplane" if accidentally contacting the water surface during the recovery stroke, whereby reducing drag;

(u) to provide a means for the above mentioned feathering blade to produce an aerodynamic lift during the recovery stroke, reducing necessary downward pressure on the handle;

(v) to provide a means for deflecting obstacles outboard, around the apparatus, and preventing an aforementioned connecting thwart from being forced rearward in a collision, causing entrapment of the oarsman.

Still further objects and advantages of my apparatus will become evident from a consideration of the drawings and ensuing description.

DRAWING FIGURES

In the drawings, closely related figures have the same number but different alphabetic suffixes. A port side mechanism has been omitted in all views to avoid repetition.

Figure 9A:
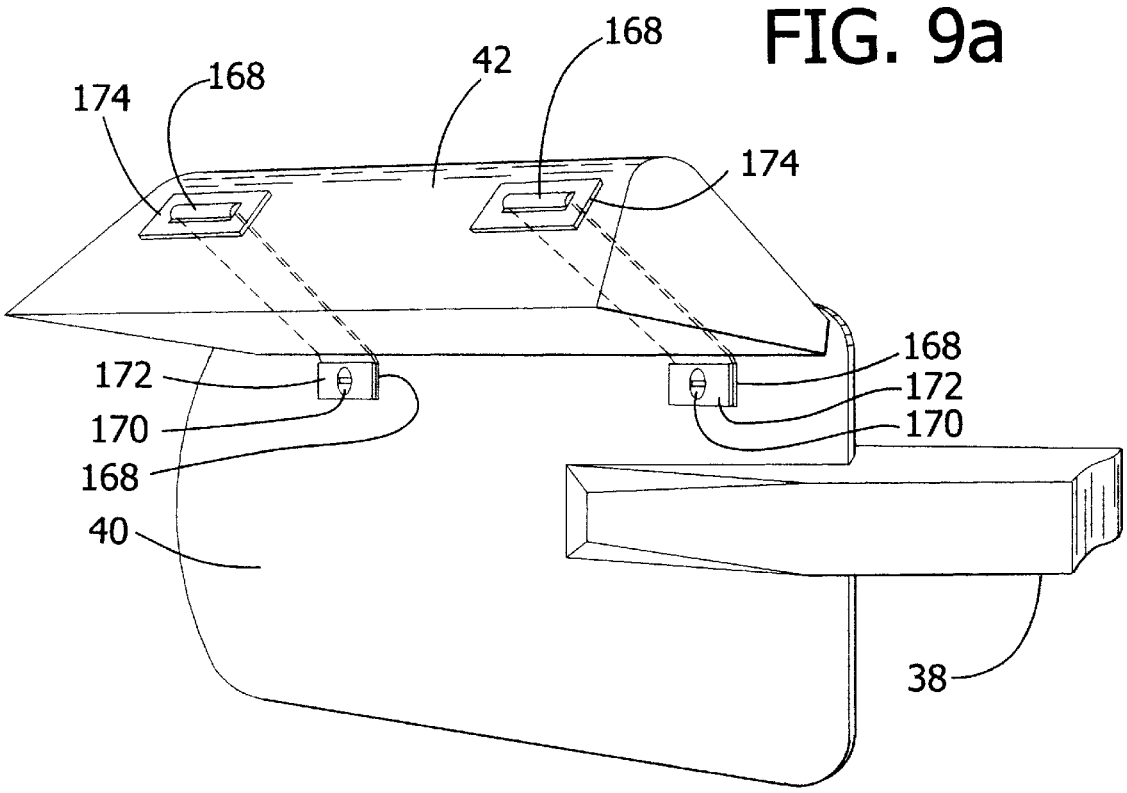

FIG. 9*a* shows a perspective view of an oar blade float attaching to the forward side of a starboard oar blade in a submerged position.

Figure 9B:
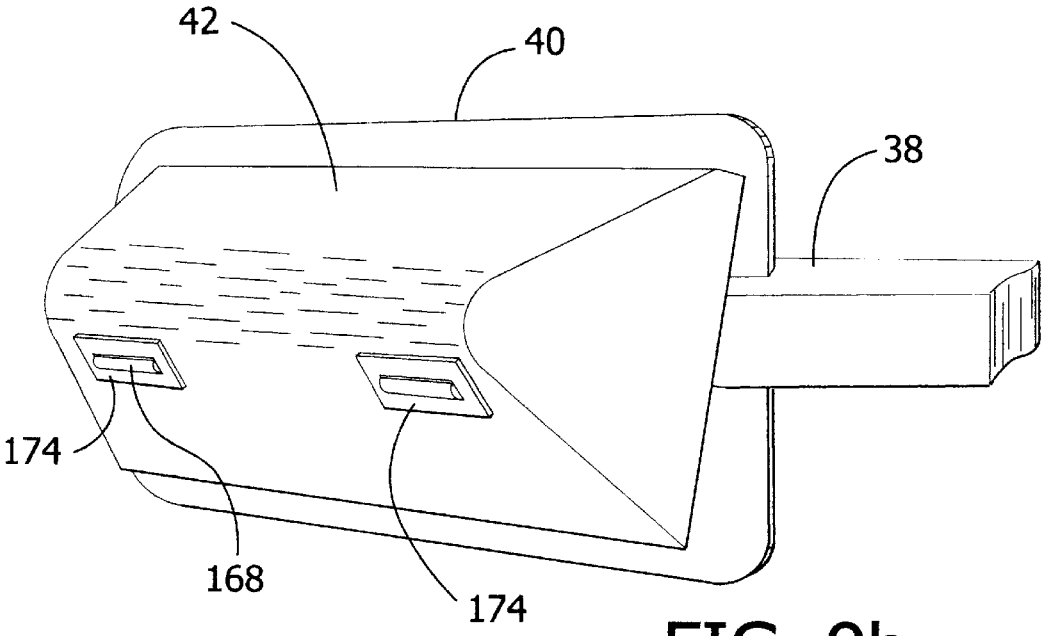

FIG. 9*b* shows the same view of the oar blade in FIG. 9*a* in a non-submerged position.

Figure 10:
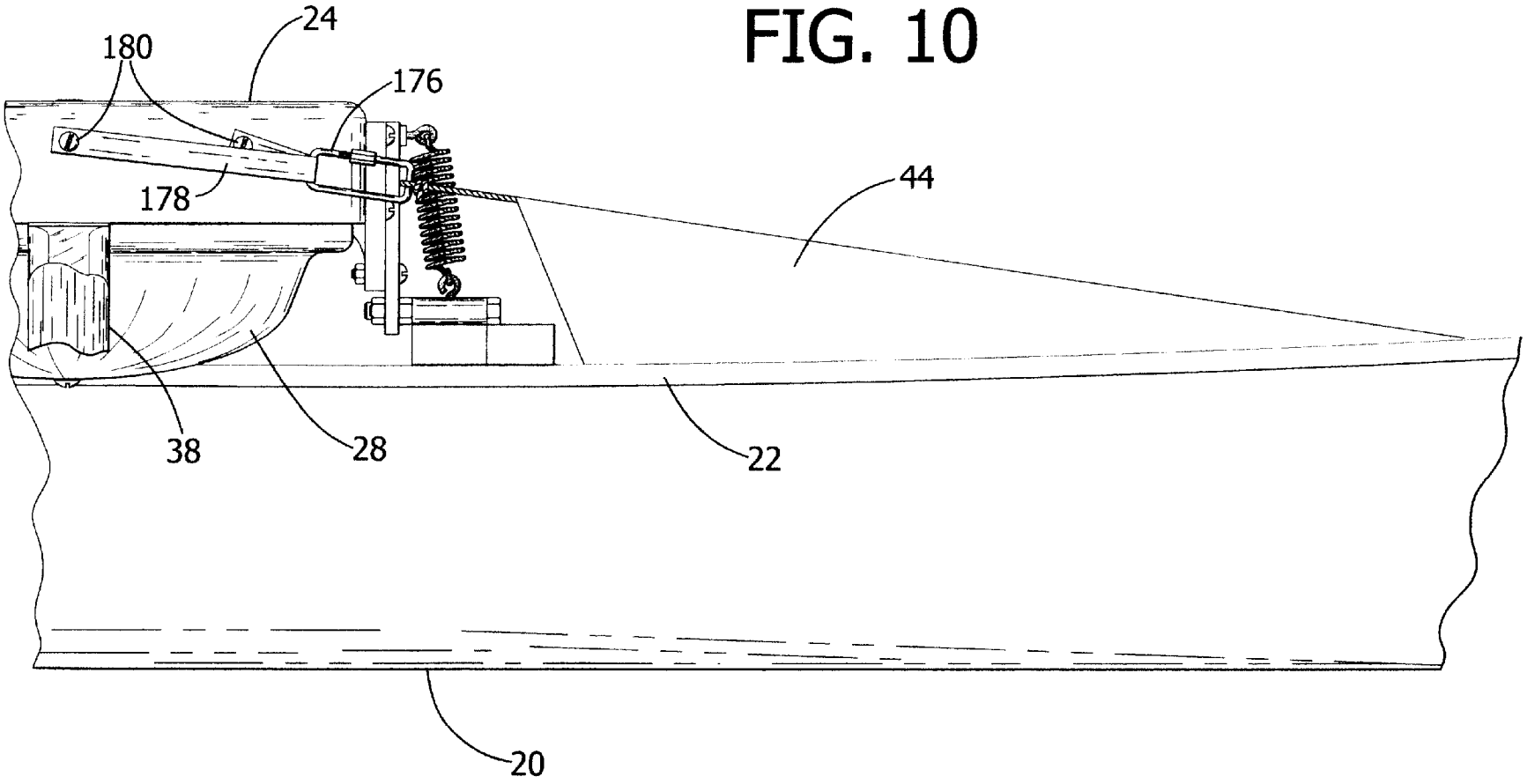

FIG. 10 shows a side elevation view of a member described herein as a pennant bumper which attaches along the gun-wale forward the starboard mechanism.

Figure 11A:
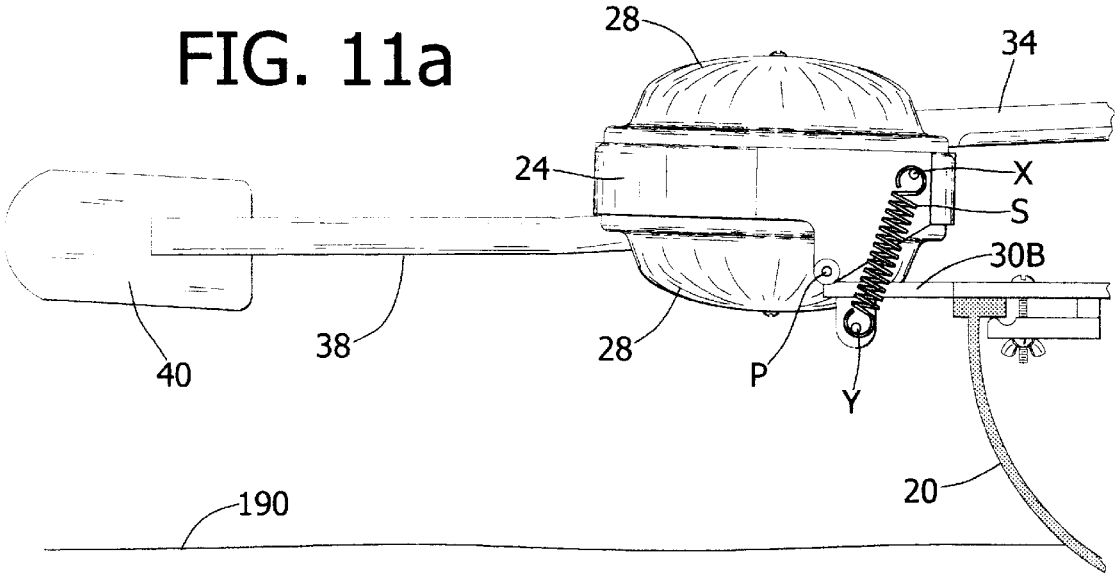
Figure 11B:
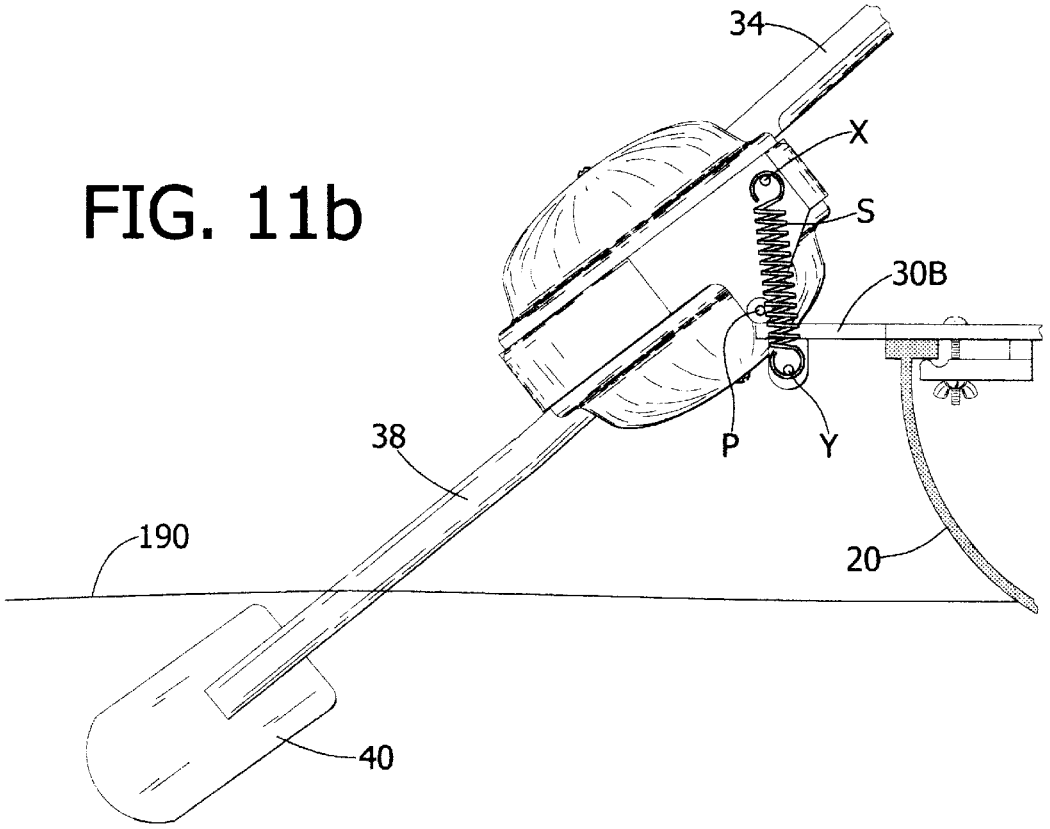

FIGS. 11*a* and 11*b* show a counterbalance spring and frame pivot arrangement of the apparatus in two positions.

Figures 4, 5, 6:
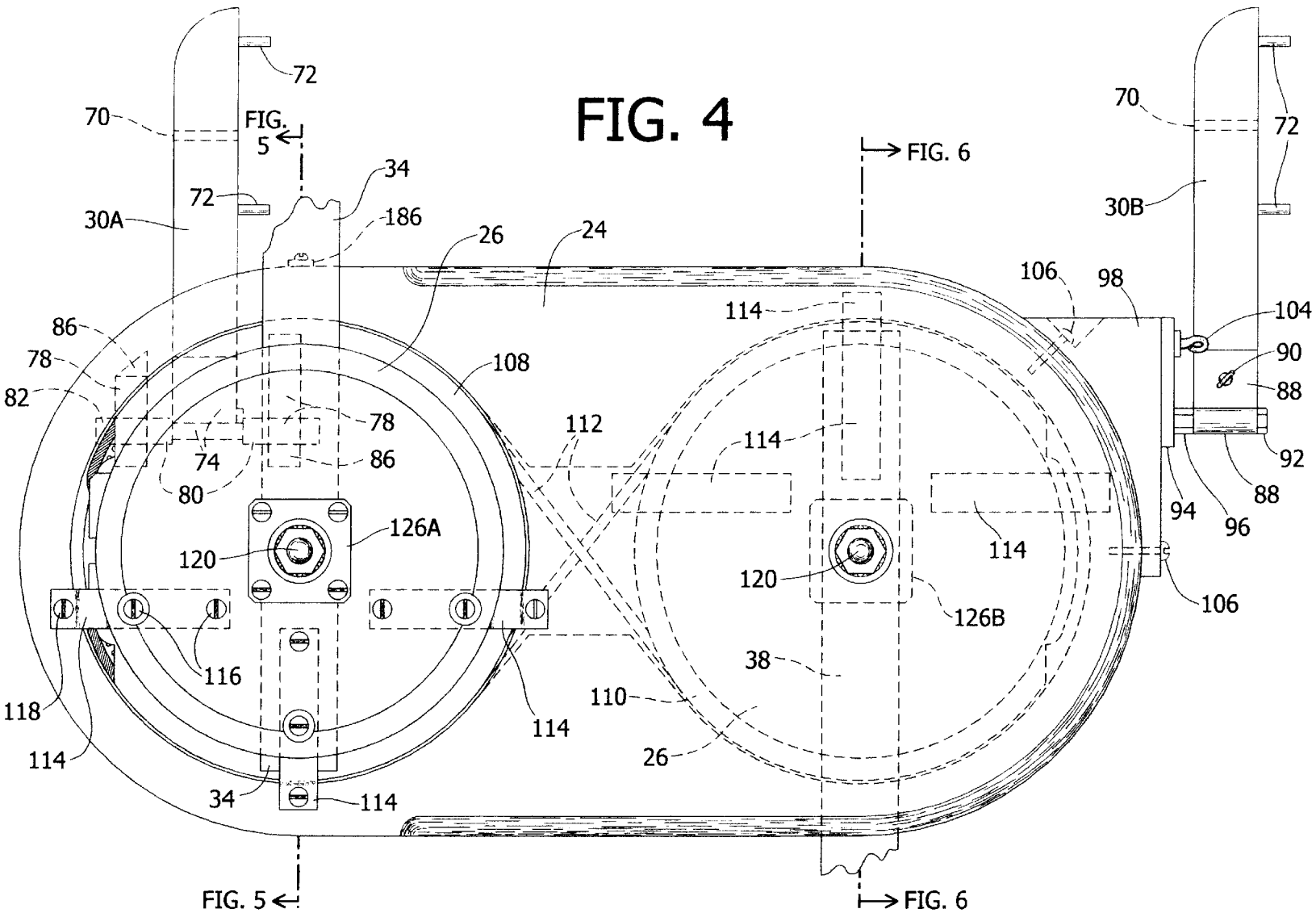
FIG. 4 shows a top plan view of the starboard mechanism.
FIG. 5 shows a sectional view of the portion indicated by section lines 5—5 in FIG. 4.
FIG. 6 shows a sectional view of the portion indicated by section lines 6—6 in FIG. 4.
Figure 5:
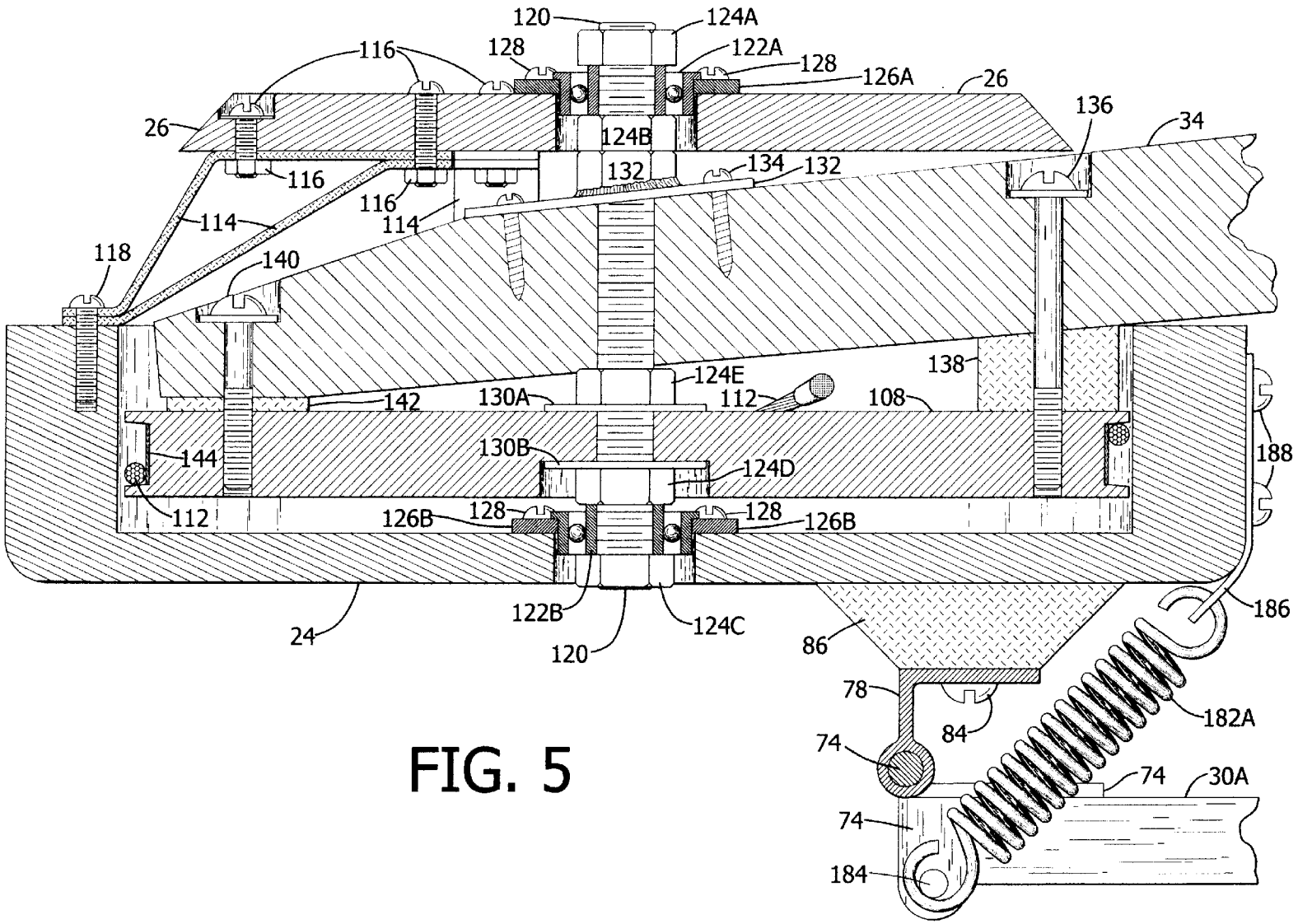
Figure 6:
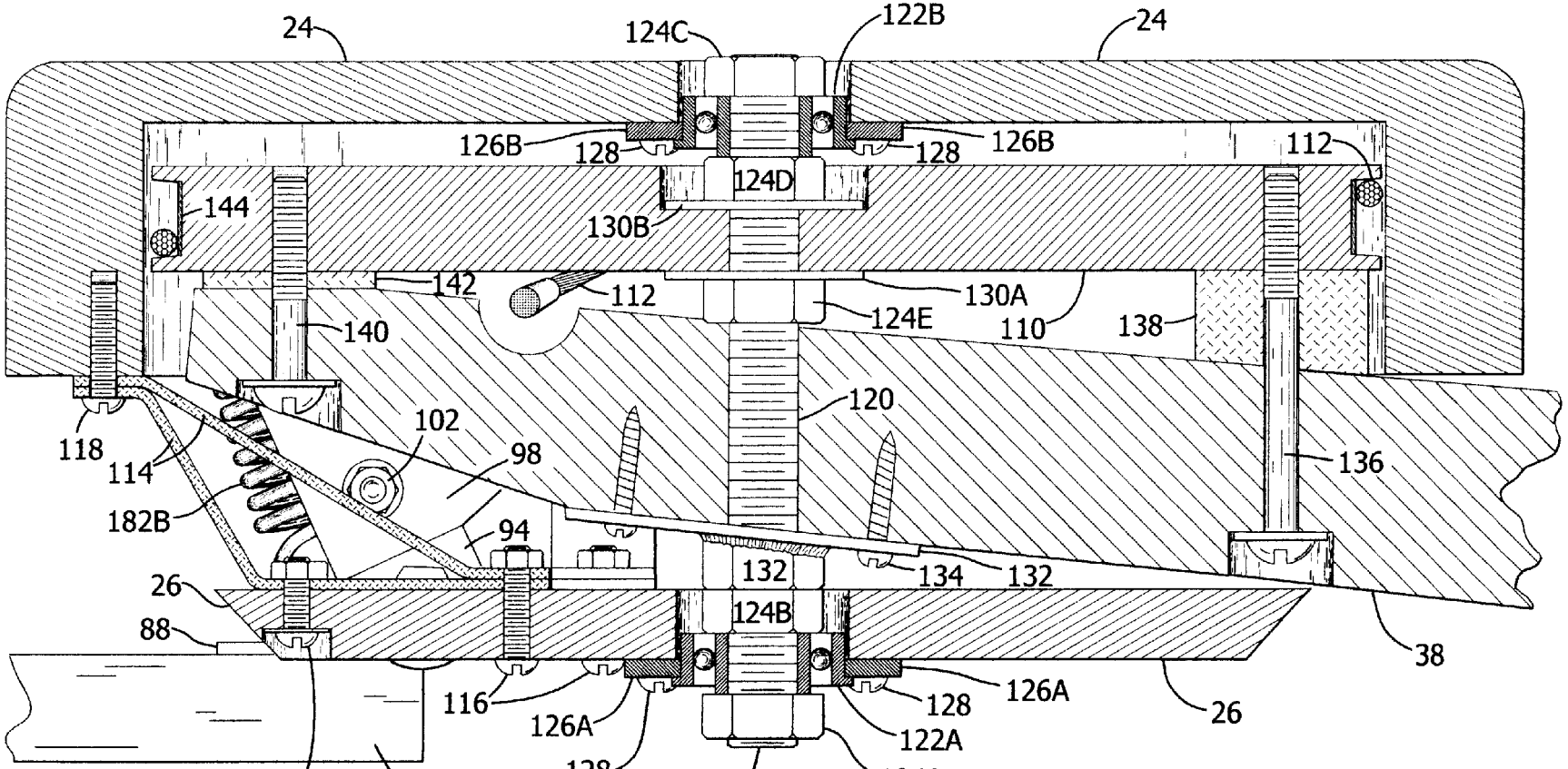
Figure 12:
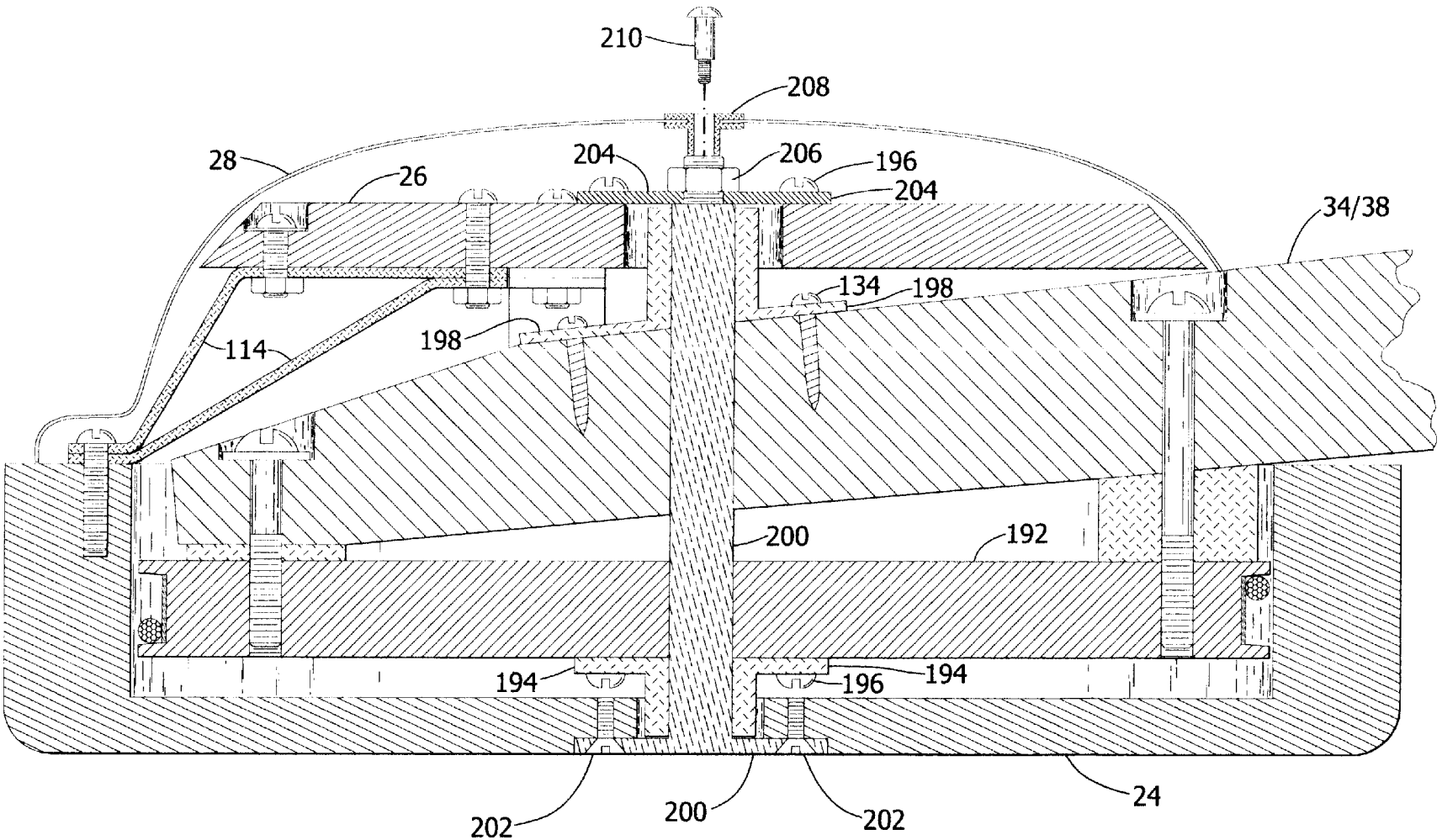

FIG. 12 shows a substituted, sectional view of FIG. 5 illustrating a variation of sheave axle design.

FIGS. 13*a* to 13*d* show top plan and elevation views of variations of frame and axle arrangement.

Figure 14:
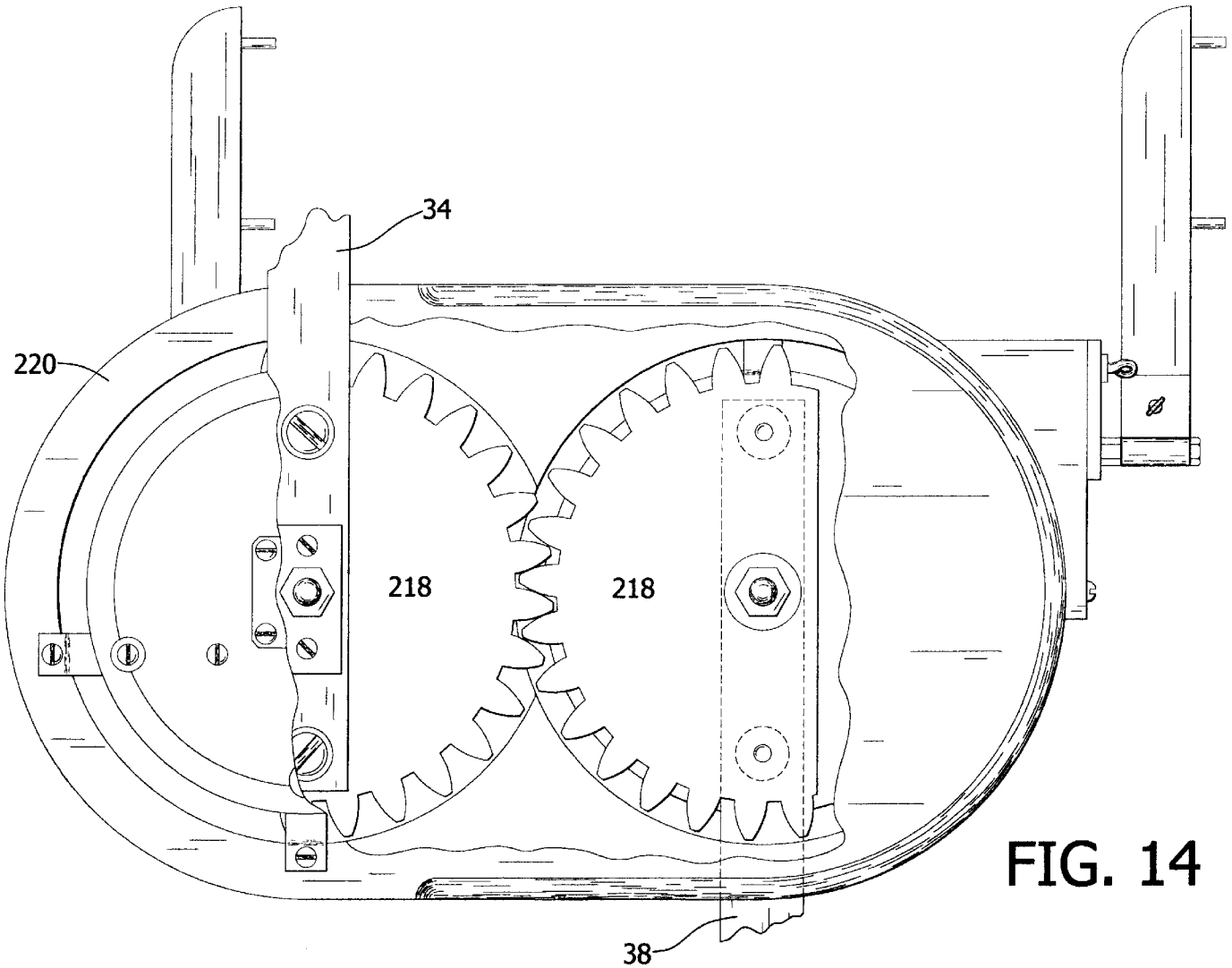

FIG. 14 shows a variation of the apparatus employing gears.

FIGS. 15*a* to 15*d* show a variation of the starboard oar blade which assumes a feathered position when raised above the water surface.

REFERENCE NUMERALS IN DRAWINGS

| | | | |
|---|---|---|---|
| 20 | canoe | 22 | gunwale |
| 24 | housing | 26 | canopy |
| 28 | canopy cover | 30A | rear outrigger |
| 30B | forward outrigger | 32 | boomerang handle |
| 34 | handle lever | 36 | fastener (for handle 32) |
| 38 | oar blade lever | | |
| 42 | blade float | 40 | oar blade |
| 46 | rear thwart | 44 | pennant bumper |
| 50 | diagonal webbing strap | 48 | forward thwart |
| 54 | mounting pad | 52 | buckle |
| 58 | hole (for pin 56) | 56 | anti-slip pin |
| 62 | bolt (for clamp 60) | 60 | clamp |
| 66 | fastener (for 30A & 30B) | 64 | wing nut (for bolt 62) |
| 70 | hole | 68 | wing nut (for bolt 66) |
| 74 | rear pivot axle | 72 | alignment pin |
| 78 | rear pivot bearing | 76 | fastener (for axle 74) |
| 82 | lock-nut | 80 | spacer (for axle 74) |
| 86 | elevation block | 84 | fastener (for bearing 78) |
| 90 | eyebolt (for bearing 88) | | |
| 94 | forward pivot plate | 88 | forward pivot bearing |
| 98 | forward mounting block | 92 | forward pivot bolt |
| 102 | nut (for bolt 100) | 96 | nut (for bolt 92) |
| 106 | fasteners (for block 98) | 100 | bolt (for plate 94) |
| 110 | oar blade sheave | 104 | eyebolt (for plate 94) |
| 114 | canopy brackets | 108 | handle sheave |
| 118 | fastener (for 114 to 24) | 112 | drive cable |
| 122A & B | bearing | 116 | fastener (for 114 to 26) |
| 126A & B | bearing plate | 120 | threaded lever axle |
| 130A & B | washer | 124A to E | jam nut |
| 134 | screw (for 132 & 198) | 128 | fastener (for plate 126) |
| 138 | heel block | 132 | nut plate |
| 142 | toe shim | 136 | heel bolt |
| 146 | anchor post | 140 | toe bolt |
| 150 | adjusting nut | 144 | wear band |
| 154 | aperture | 148 | threaded stud end |
| 158 | washer | 152A & B | passageway |
| 162 | wear elbow | 156 | stop sleeve |
| 166 | retainer plate | 160 | small fastener |
| 170 | fastener (for strap 168) | 164 | depression |
| 174 | anchor plate | 168 | hinge strap (for float 42) |
| 178 | strap (for hook 176) | | |
| 182A & B | counterbalance spring | 172 | rectangular washer |
| 186 | housing anchor | 176 | detachable hook |
| 190 | water surface | 180 | fastener (for strap 178) |
| 194 | sheave bearing | 184 | anchor pin |
| 198 | lever bearing | 188 | fastener (for anchor 186) |
| 202 | recessed fastener | | |
| 206 | axle nut | 192 | sheave (FIG. 12 variation) |
| 210 | shoulder bolt | | |
| 214 | housing (FIG. 13a) | 196 | fastener (for 194 & 204) |
| 218 | gear | | |
| 222 | featherable oar blade | 200 | flanged axle |
| 226 | webbing hinges | 204 | mounting plate |
| 230 | fastener (for 226 to 224) | 208 | canopy cover bearing |
| 234 | float anchor | 212 | pivot axis |
| 238 | torsion spring | 216 | housing (FIG. 13c) |
| 242 | fastener (for spring 238) | 220 | housing (gear version) |

-continued

| | | | |
|---|---|---|---|
| 246A | edge (of blade 222) | 224 | oar shaft |
| 248 | torsion spring (alternate) | 228 | fastener (for 226 to 222) |
| 252 | screw eye | | |
| | | 232 | hydroplane float |
| | | 236 | fastener (for 234 to 222) |
| | | 240 | hole (for spring 238) |
| | | 244 | blade stop |
| | | 246B | rear edge (of float 232) |
| | | 250 | mandrel (for spring 248) |
| | | 254 | fastener (for 252 to 250) |

SUMMARY

A rowing apparatus which allows an oarsman to face forward while propelling a watercraft such as a canoe forward when pulling on handles. The articulated apparatus, which is capable of 180° of stroke, includes first and second sheaves coupled by a pair of cables enclosed within a frame. An upper side of the first sheave attaches to a handle lever, which attaches at its inboard end to a detachable, obtuse-angle shaped handle. An under side of the second sheave attaches to an oar blade lever, which extends to an oar blade. Each sheave has an axle supported at its extremities by a frame. A pair of outriggers pivotally support the frame at an outboard location. The outriggers attach to a pair of thwarts, which include a pair of diagonal braces. This arrangement prevents flexing of the hull from twisting pressures generated by the apparatus. Mounting pads, which attach with an adhesive to the upper surface of each gunwale, accept pins projecting from the under side of the thwarts to prevent slipping. Counterbalance springs compensate for imbalance of the design and overhang of the oar blade. Spring tension transfers to the thwarts and ultimately to a downward pressure on the gunwales. The arrangement of each spring provides a reduction of lifting pressure to each oar blade when in a submerged position. An oar blade float, which attaches to the upper portion of the oar blade, prevents the oar blade from submerging excessively. The oar blade float has a hinged attachment to the oar blade. This allows the float to drop to a position that reduces aerodynamic drag of the blade when raised above the water surface. An added variation of oar blade and oar blade float possesses a hinged attachment between oar blade and its shaft. This variation automatically pivots to a feathered position when not submerged in water. This variation includes under surfaces of the oar float and oar blade arranged to "hydroplane" if accidentally contacting the water surface during the recovery stroke. Additionally, this variation provides a small, but beneficial amount of aerodynamic lift to the blade during the recovery stroke. Serving as a bumper, a triangular flaglike structure attaches to the frame and hull forward of the frame.

DESCRIPTION-FIGS. 1 TO 10

Figure 1:
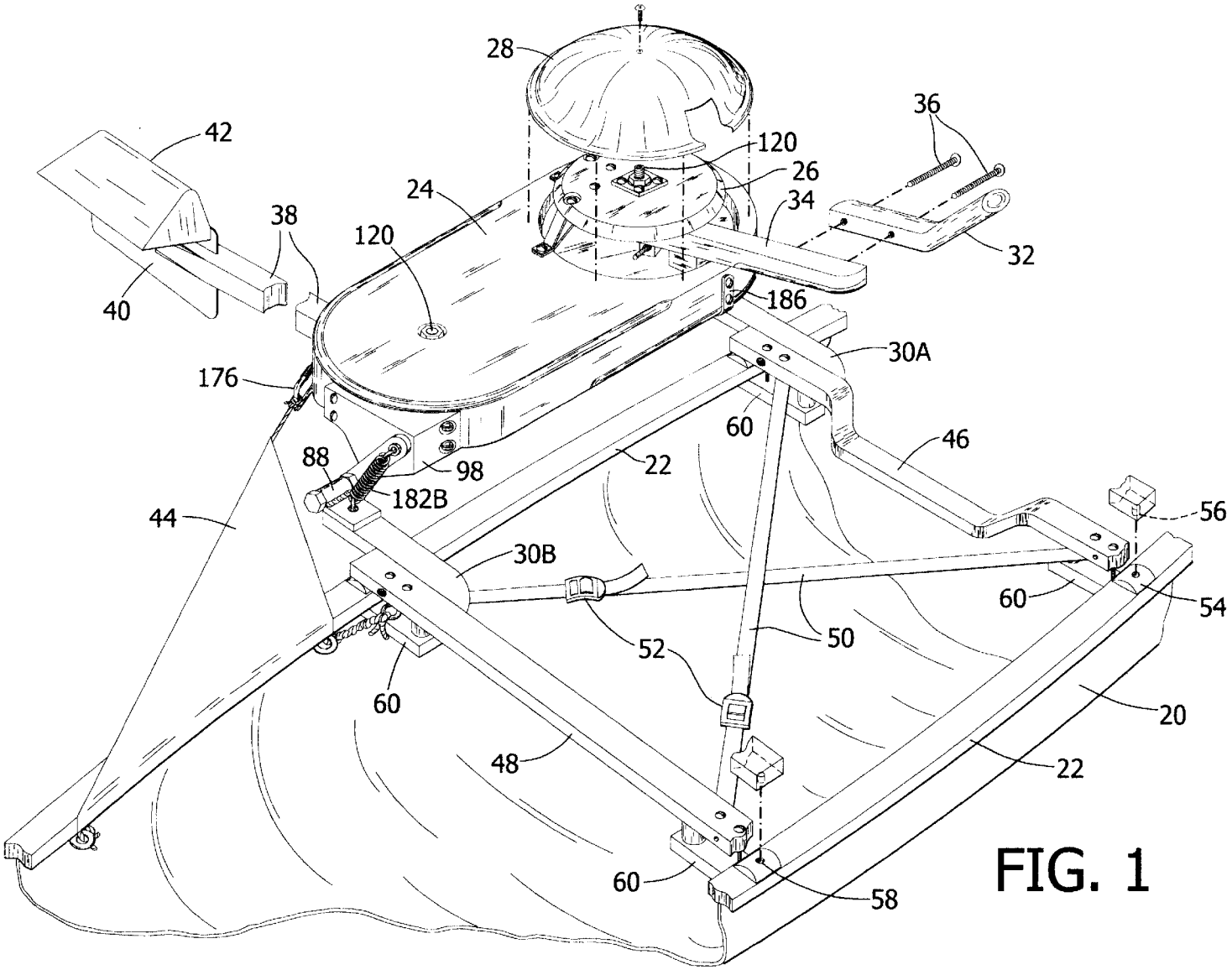
FIG. 1 shows an overall, perspective view from a forward position of a starboard mechanism, along with associated members mounted to a canoe.

FIG. 1 presents an overall view of a preferred embodiment of the invention. The illustration omits a port side mechanism, being identical to the starboard side with the exception of being opposite hand. FIG. 1 shows a portion of a canoe 20 having a gunwale 22 on both port and starboard sides. Major frame parts in this view include a housing 24 and a canopy 26. A lower canopy 26 is not visible in this view, as it has a position on the underside of housing 24. A pair of canopy covers 28 (upper shown only and removed) cover upper and lower canopies 26. A rear outrigger 30A and a forward outrigger 30B provide pivotal support to housing 24 along an axis outboard of gunwale 22. This axis, which is below housing 24, is generally parallel with the gunwale of the same side.

The mechanism includes a boomerang handle 32 having an obtuse-angled shape of approximately 150° (FIG. 1). One projection of handle 32 attaches to a rear surface of an inboard portion of a handle lever 34 by a pair of fasteners 36. Lever 34 couples to an oar blade lever 38 within housing 24 (internal coupling not shown in this view). Lever 38 (shown with a length removed) attaches at its outboard end to an oar blade 40. A blade float 42, which is of a low density material buoyant in water, attaches to an upper portion of blade 40.

For the deflection of obstacles, a triangular flaglike structure, described as a pennant bumper 44, attaches to housing 24 and canoe 20 (FIG. 1). A rear thwart 46 and a forward thwart 48 span port and starboard gunwales 22. Thwarts 46 and 48 are an integral part of the whole apparatus and rigidly secure to both port and starboard gunwales 22. Rear thwart 46 curves downward and forward at its mid-section. This combined dip and forward arch provide more handle and knee clearance respectively. In this embodiment, each of thwarts 46 and 48 comprise a individual part. However, thwarts 46 and 48 can have adjustable sections to adapt to different beam dimensions. A pair of diagonal webbing straps 50 forming an "X" brace connect at opposite ends to thwarts 46 and 48. A pair of buckles 52 provide a manner to adjust and eliminate excess slack in each strap 50.

Figure 2:
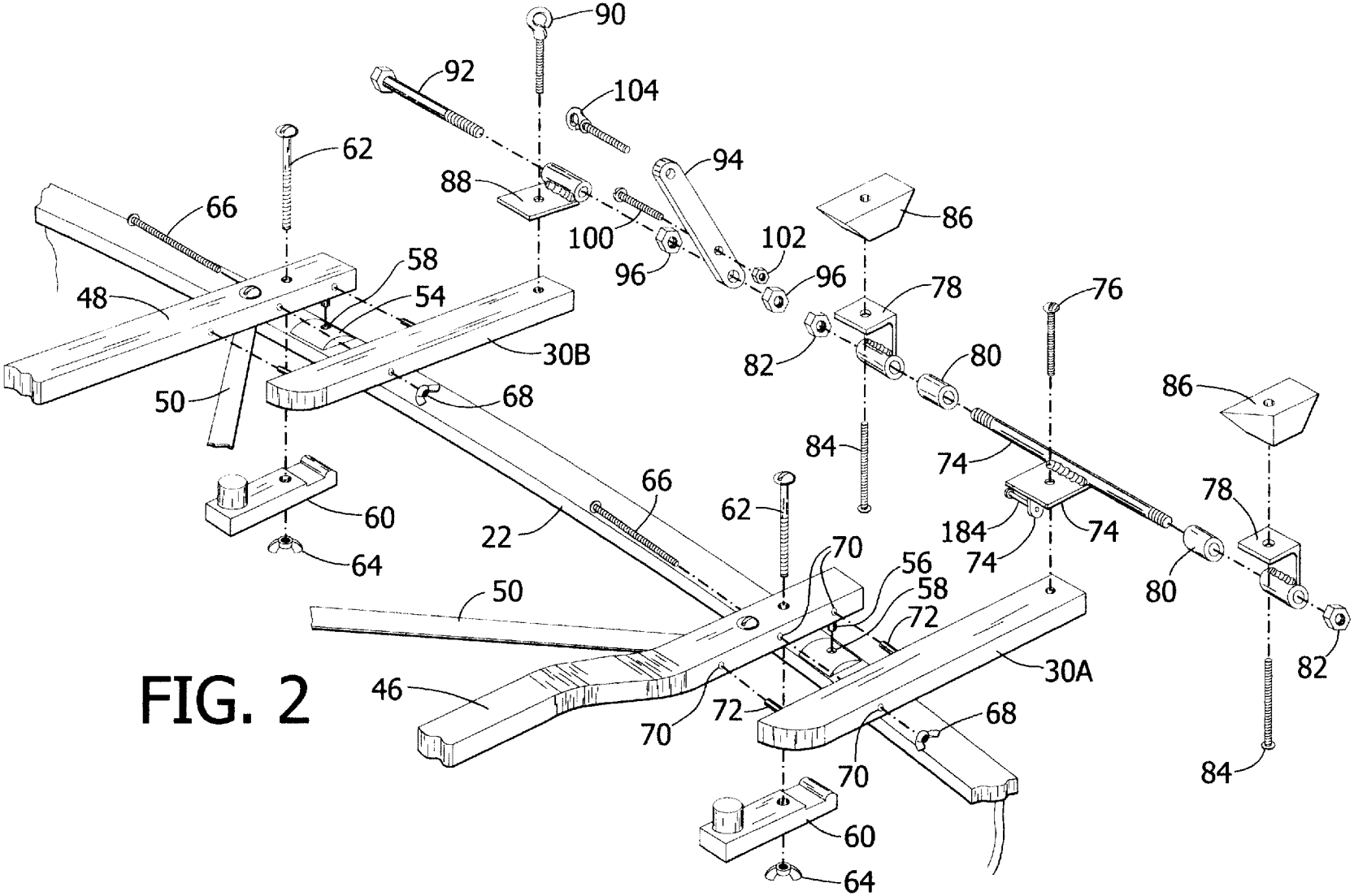
FIG. 2 shows an enlarged, exploded, perspective view from a rearward position of a starboard gunwale, along with associated members.

FIG. 2 shows an enlarged, detailed view of the attachment of rear thwart 46 to gunwale 22. Rear thwart 46 rests on a mounting pad 54, which attaches to gunwale 22 by a suitable adhesive. Rear thwart 46 also includes an anti-slip pin 56, which keys or engages into a hole 58 in pad 54. A cylindrical upper surface of pad 54 provides an interface of non-parallel surfaces of thwart 46 and gunwale 22. This cylindrical surface causes thwart 46 to rest on an elongated central area of pad 54. A clamp 60, a bolt 62, and a wing nut 64 hold down thwart 46 to gunwale 22. Rear outrigger 30A attaches to a rear surface of thwart 46 by means of a fastener 66 and a wing nut 68. Holes 70 in thwart 46 and outrigger 30A accept fastener 66 and a pair of alignment pins 72, which rigidly attach to outrigger 30A.

Forward outrigger 30B attaches to forward thwart 48 in the same manner as rear outrigger 30A attaches to rear thwart 46. Likewise, the attachment of both opposite ends of both thwarts 46 and 48 to gunwale 22 is identical. As can be seen in FIGS. 1 and 2, outriggers 30A and 30B extend outboard beyond gunwale 22.

Figure 3:
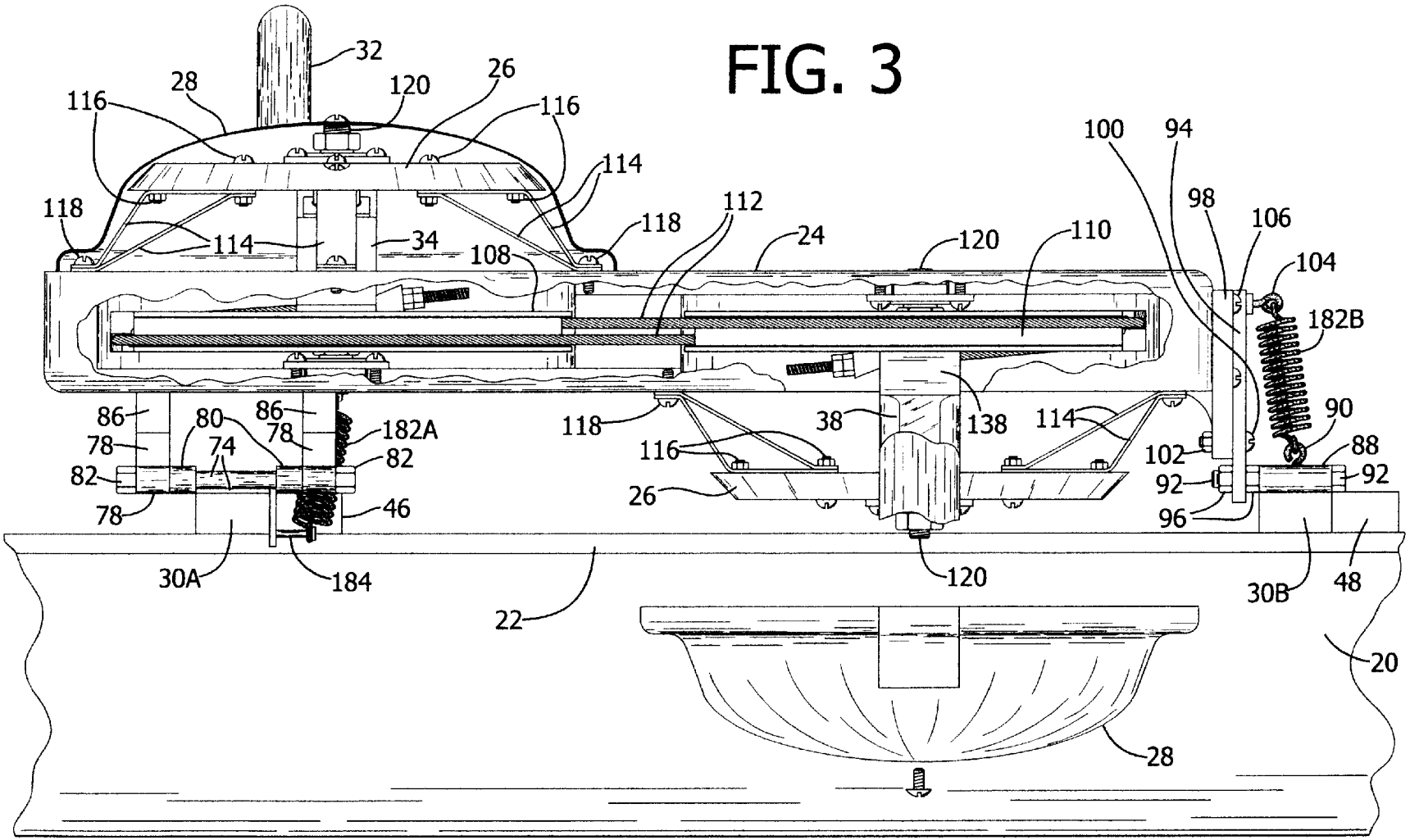
FIG. 3 shows a side elevation view of the same starboard mechanism viewed from an outboard position, the mechanism includes a cutaway section revealing internal members.

FIG. 2 shows a rear pivot axle 74, which mounts to an upper surface of an outboard end of outrigger 30A by a fastener 76. Axle 74 comprises a shaft which rigidly attaches parallel to a surface of one end of a rectangular mounting plate, the shaft extending at opposite ends. Axle 74 also includes an appendage plate extending from an edge of the mounting plate, a side of the appendage plate being perpendicular to the mounting plate and the shaft. A pair of rear pivot bearings 78, each comprising a bearing rigidly attached to an "L" shaped bracket, receive opposite axle ends of axle 74 (FIG. 2). A pair of spacers 80, one on each side of outrigger 30A, sleeve onto opposite axle ends of axle 74 between bearings 78. A pair of lock-nuts 82, one threaded onto each opposite axle end of axle 74, retains spacers 80 and bearings 78. Referring to FIGS. 2, 3, and 5, each bearing 78 attaches to housing 24 by a fastener 84. An elevation block 86 sandwiches between each bearing 78 and housing 24 to provide proper height of housing 24.

A forward pivot bearing 88 (FIGS. 2 to 4) comprises a bearing rigidly attached to a plate. Bearing 88 mounts to an upper surface of an outboard end of forward outrigger 30B by an eyebolt 90. A forward pivot bolt 92 pivots in bearing 88 and secures to a forward pivot plate 94 by compression of nuts 96. Plate 94 attaches to a forward mounting block 98 by a bolt 100, a nut 102, and an eyebolt 104. Eyebolt 104 secures to block 98, which mounts to a forward cylindrical surface of housing 24 by a plurality of fasteners 106. Block 98 interfaces and mounts the flat surface of plate 94 to the forward cylindrical surface of housing 24.

FIGS. 1, 3 to 6 show different views of housing 24, which typically comprises an elongated structure with half-round forward and rear ends. To simplify, the illustrations represent housing 24 as a single unit or piece. To facilitate manufacturing, housing 24 can comprise upper and lower molded halves which attach together. A molded half can serve as either upper or lower half, on either port or starboard side of the boat. The interior of housing 24 includes a major cavity with forward and rear portions. This cavity contains drive members to be described. The illustrated embodiment includes a passageway connecting forward and rear cavity portions. When oriented in an operational position, housing 24 has an upper surface with a large circular opening in a rear half of the structure. This circular opening leads into the above mentioned cavity. Likewise, an under surface has a large circular opening located in a forward half of the structure. This lower opening also leads into the above mentioned cavity.

FIG. 3 shows a section of housing 24 cutout, revealing some of the drive members. FIGS. 3 and 4 show a handle sheave 108 and an oar blade sheave 110 coupled together by a pair of drive cables 112. Cables 112 crisscross between peripheries of sheaves 108 and 110. This crisscross pattern causes the sheaves to rotate in opposite directions. This preferred embodiment employs stranded cable attached to each sheave. A separation between the peripheries of sheaves 108 and 110 enables the portion of cable between the sheaves to absorb the reciprocating shock.

FIG. 3 shows lower canopy cover 28 removed and upper cover 28 with its facing half cutaway to reveal enclosed members. FIG. 4 does not include covers 28. In case of accidental impact of cover 28, canopy 26 includes 360° of circumference, which functions as a backup reinforcement (FIGS. 3 and 4). Each canopy 26 attaches to three sets of canopy brackets 114 by fasteners 116. Brackets 114 support each canopy at a spaced distance from each previously mentioned circular opening of housing 24. Although this embodiment shows fasteners 116 as bolt and nut sets, another suitable fastening means such as rivets can serve as well. An opposite end of each bracket 114 attaches to an area just outside the circular opening of housing 24 by a fastener 118.

FIG. 5 illustrates a sectional view of the mechanism through section lines 5—5 in FIG. 4. To provide space for reference numerals, this view excludes cover 28. A threaded lever axle 120 receives support at opposite ends by a pair of bearings 122A and 122B. The upper end of axle 120 secures to an inner race of bearing 122A by compression of jam nuts 124A and 124B. Bearing 122A rigidly attaches to a bearing mounting plate 126A, which attaches to an upper surface of canopy 26 by a plurality of fasteners 128. Canopy 26 includes a bore at its center to receive bearing 122A, nut 124B, and axle 120. The opposite, lower end of axle 120 secures to an inner race of bearing 122B by compression of jam nuts 124C and 124D. A bearing 122B rigidly attaches to a bearing mounting plate 126B, which attaches to an interior surface of housing 24 by fasteners 128. Housing 24 includes a bore at a location equal distant from its sides and rearward end, forming a recess to receive bearing 122B, nut 124C, and axle 120.

Continuing with FIG. 5, sheave 108 rigidly attaches at its axial center to axle 120 by compression of nuts 124D and 124E. A pair of washers 130A and 130B transfer compression pressure of nuts 124D and 124E to sheave 108. In this preferred embodiment, sheaves 108 and 110 comprise a moldable material, such as a glass reinforced plastic. A pocket on the lower side of sheave 108 provides recess for nut 124D and washer 130B. A nut plate 132 secures to lever 34 by a pair of screws 134. Plate 132 rigidly attaches to axle 120 by downward compression of nut 124B. Lever 34 rigidly mounts to sheave 108 by heel bolt 136. A heel block 138 provides the proper height for the exit of lever 34. A toe bolt 140 secures an end of lever 34 to sheave 108. A toe shim 142 provides the proper lever angle and position. In this particular embodiment, lever 108 extends on a 5° angle relative to sheave 108, but this angle can vary in other embodiments.

FIG. 6 shows a view of the mechanism through section lines 6—6 (FIG. 4) with the exclusion of canopy cover 28. In this view, all internal members have an inverted orientation in relation to FIG. 5. Lever 38 includes a cutout, providing clearance for cable 112. Sheave 110 is identical to sheave 108, with the exception of having an opposite hand or mirrored location for bolts 136 and 140. All remaining internal members of FIG. 6 are identical to members in FIG. 5. As FIGS. 5 and 6 reveal, the diameters of sheaves 108 and 110 are smaller than the openings of housing 24 to facilitate assembly. Both FIGS. 5 and 6 show cross sections of each cable 112 in a single groove along the periphery of each sheave 108 and 110. A wear band 144 encircles each sheave 108 and 110 along the bed of each groove. Each band 144 comprises a steel band for preventing wear of each sheave.

Figure 7:
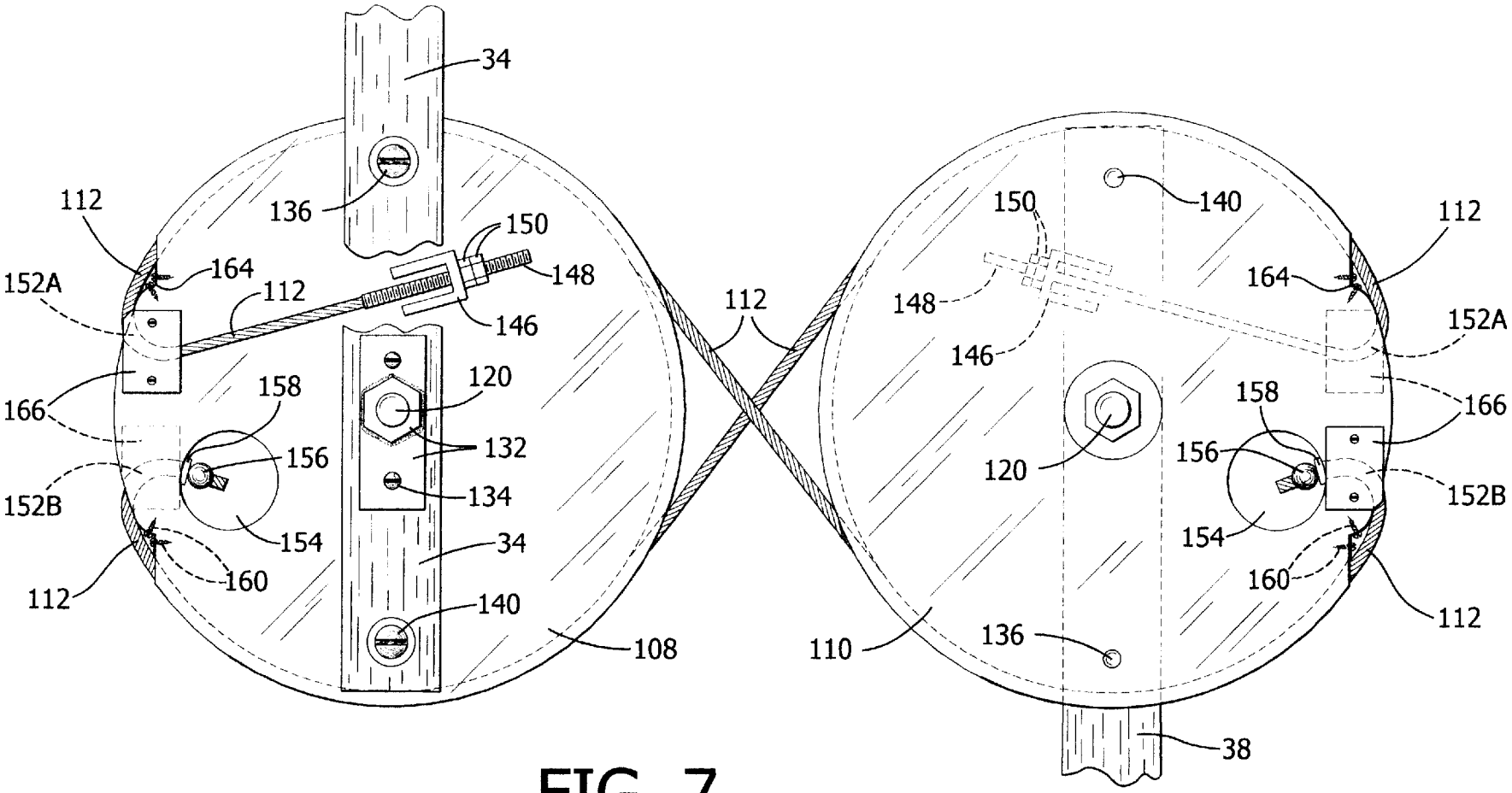
FIG. 7 shows a top plan view of a cable drive and cable tensioner configuration disposed within a member described herein as a housing.

FIG. 7 illustrates the cable and sheave configuration along with tensioner members. This is a view from above, showing only members related to the cable system. For illustrative purpose, lever 34 shows a cutout revealing an anchor post 146 rigidly attached to sheave 108. Post 146 has a hole to receive a threaded stud end 148, which attaches to cable 112. A pair of adjusting nuts 150 thread onto end 148 for adjusting tension of cable 112. Nuts 150 tighten or jam against each other to prevent unwinding on end 148. From post 146, cable 112 extends down a ramplike channel in sheave 108, and through a curving passageway 152A, which leads to the peripheral groove of sheave 108. An opposite end of this cable enters a passageway 152B at the periphery of sheave 110. Each passageway 152B leads to an aperture 154 in the interior of each sheave. Stop sleeve 156 and washer 158 secure this opposite cable end within aperture 154. Both sheaves 108 and 110 include identical members and cable adjustment, providing a means to compensate for differences in cable length.

Figure 8:
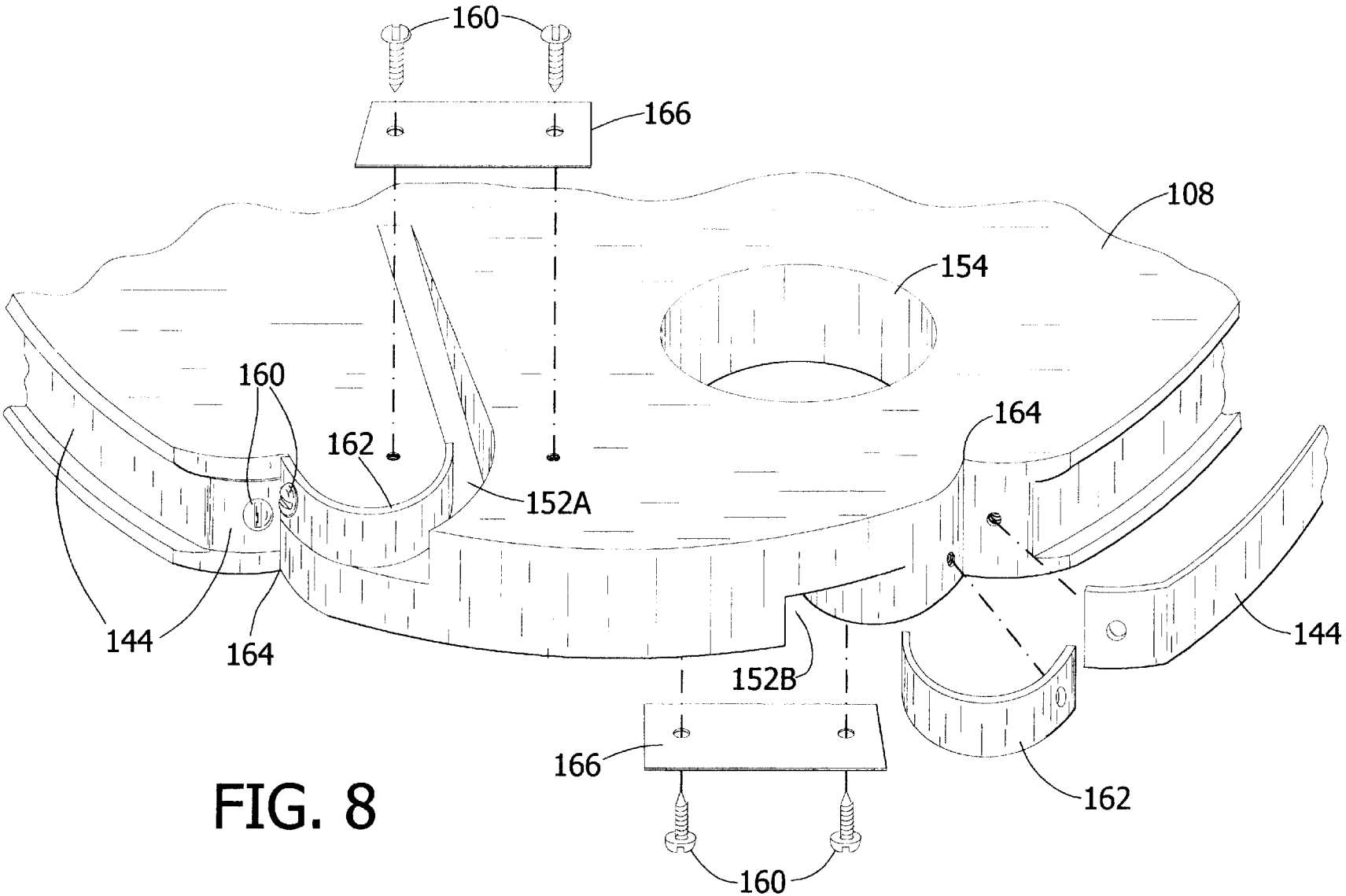
FIG. 8 shows an enlarged, prospective view of a sheave where drive cables enter the interior of the sheave.

FIG. 8 is an enlarged perspective view of the portion of sheave 108 where cables 112 enter passageways 152A and 152B. For a clear view, this illustration does not include cables 112. A small fastener 160 secures each opposite end of wear band 144 to sheave 108. Fasteners 160 also retain a pair of wear elbows 162 within each passageway 152A and 152B. Elbows 162 prevent wear of each sheave by cables 112. Each sheave includes a small depression 164 at its periphery as a recess for fasteners 160. A pair of retainer plates 166 cover passageways 152A and 152B. Plates 166 attach to sheave 108 by fasteners 160. Each plate 166 functions to retain each cable 112 within passageways 152A and 152B. Sheaves 108 and 110 have identical cable components, which are inverted relative each other.

It is important to mention that the preferred embodiment also includes pockets and holes in various members for reducing weight. To simplify, the illustrations do not show these weight reducing pockets and holes. Members such as sheaves 108 and 110, canopies 26, and housing 24 include these pockets and holes where structural integrity or function is not excessively compromised.

FIGS. 9*a* and 9*b* illustrate the attachment of blade float 42 to oar blade 40, as well as the lower end of oar blade lever 38. Float 42 comprises a low density, buoyant material, such as polyethylene plastic foam. A plurality of webbing hinge straps 168 attach to an upper edge of blade 40 by a plurality of fasteners 170. Each strap 168 comprises a flexible, woven material, which serves as a joint or hinge. A rectangular washer 172 sandwiches between each fastener 170 and each strap 168. Each washer 172 compresses strap 168 to blade 40 and provides a pivotal edge for each strap 168. Each strap 168 extends through float 42 and secures to an anchor plate 174.

FIG. 1 shows lever 38 with a "cut out" near housing 24. Not shown, lever 38 can include a detachable joint at or near the "cut out" area to facilitate portability. This can comprise a round or square, male-female joint with a compression clamp to firmly secure inboard to outboard segments.

FIGS. 1 and 10 illustrate views of the attachment of pennant bumper 44. A forward corner of bumper 44 attaches to an S-hook, which attaches to the inboard, underside of gunwale 22. A rearward, inboard corner of bumper 44 attaches to forward thwart 48 and an S-hook, which attaches to the inboard, underside of gunwale 22. The rearward, outboard corner of bumper 44 attaches to a detachable hook 176 (FIG. 10). Hook 176 attaches to a strap 178, which attaches to housing 24 by a pair of fasteners 180. Another fastening device, such as a buckle, can substitute hook 176.

Referring back to FIGS. 3 and 5, the aforementioned appendage plate of axle 74 rigidly supports an anchor pin 184. A counterbalance spring 182A attaches at one end to pin 184. FIG. 5 shows the opposite end of spring 182A attaching to a housing anchor 186, which secures to housing 24 by a pair of fasteners 188. FIG. 3 illustrates a second spring 182B, which attaches between eyebolts 90 and 104. FIG. 4 does not show springs 182A and 182B.

OPERATION

This embodiment of the rowing apparatus comprises a design specifically for an open canoe with gunwales. However, with modification obvious to someone skilled in the art, this embodiment can adapt to most similar watercraft such as a rowing shell or skiff. In a canoe, the apparatus enables the oarsman to see and avoid obstacles, such as when using a paddle. An oarsman employing the apparatus can travel, turn, and accelerate more rapidly than with a paddle. The apparatus enables a canoe designed for speed and tracking ability to turn as fast as a canoe designed for white water maneuvering using a paddle. The apparatus harnesses body muscles more efficiently than paddling, without twisting of the body. The extra available power and speed of the oar blade imparts greater canoe speed than using a paddle.

The following is a description of operation of the apparatus in an open canoe starting with FIGS. 1 and 2. The apparatus attaches to canoe 20 by placing thwarts 46 and 48 on four mounting pads 54, which attach to both gunwales 22 by a suitable adhesive. Regardless of an inboard or outboard slope of the upper surface of gunwale 22, each pad 54 maintains a centralized resting area on its cylindrical upper surface. The cylindrical surface prevents a gap between non-parallel mating surfaces. Holes 58 receive pins 56, preventing horizontal slipping of thwarts 46 and 48 on pads 54. Clamps 60 swivel to position under an under surface of gunwale 22. Each clamp 60 holds down thwarts 46 and 48 on pads 54 by tension of wing nut 64 and bolt 62. Thwarts 46 and 48 control flexing of the hull by twisting forces of the apparatus. Diagonal straps 50 control port and starboard movement of thwarts 46 and 48 relative each other. The necessity of straps 50 become apparent when using one or both oar blades in turning. Buckles 52 allow the operator to remove and adjust excess slack in straps 50. Thwarts 46 and 48 can remain attached to canoe 20 for transport on a vehicle, as they do not extend outboard of gunwales 22.

Outriggers 30A and 30B mount to a rear surface of thwarts 46 and 48. Holes 70 accept alignment pins 72 and fasteners 66. Wing nuts 68 thread onto fasteners 66 for compressing outriggers 30A and 30B to respective thwarts 46 and 48.

At this time, the oarsman can attach each pennant bumper 44 at its three points to gunwale 22, thwart 48, and housing 24 (FIGS. 1 and 10). The adjustment to remove excess slack in bumper 44 should not be excessively tight, restricting the movement of housing 24. Bumper 44 serves as a structure for the deflection of obstacles around housing 24. Bumper 44 prevents thwart 46 from being forced rearward in a hard collision, causing entrapment of the oarsman.

Each oar blade lever 38 can now be attached conveniently at each detachable joint (previously described but not shown). At least one oar blade lever 38 is then rotated to a forward retracted position approximately parallel to gunwale 22. In this position, the oarsman is not obstructed by lever 38 when entering canoe 20.

With the exception of being in a forward facing position, the oarsman operates the apparatus in the same manner as with conventional oars. For a person accustomed to conventional rowing, the reversed motion can momentarily confuse. However, within an hour or two of practice, the oarsman should be able to maneuver satisfactory in calm water conditions.

Boomerang handles 32 project upward approximately thirty degrees from handle levers 34. This upward projection places the oarsman's fingers above rear thwart 46, preventing accidental striking of fingers during the recovery or return stroke. Also, it provides a more relaxed position of wrists throughout rowing strokes. Handles 32 demountably attach to a relatively long rear surface area of levers 34 to withstand the pulling pressure without breakage. The attachment to the rear surface additionally provides greater reach of the oarsman. A substitution of handles 32 for other handles of different lengths can adjust to different canoe widths.

An important feature of the apparatus is that the internal drive members are fully enclosed to protect fingers from injury by closing parts. The stroke is limited to approximately 180° by levers 38 and 40 contacting or stopping against canopy brackets 114. Personal or finger injury is prevented at these areas by canopy covers 28, which enclose these areas while rotating with levers 34 and 38. The exterior edges of housing 24, levers 34 and 38 are rounded to prevent a shearing action, again for preventing personal injury.

Counterbalance springs 182A and 182B (best shown in FIGS. 1, 3 and 5) are essential components of this apparatus. Because the pivot of housing 24 is inboard, relative the center of mass, an imbalanced situation occurs (see FIG. 5). Springs 182A and 182B function to compensate for this imbalance by imparting a lifting pressure to oar blade 40. Without this compensation, an excessive amount of downward pressure on handle 32 would be necessary to raise oar blade 40 out of water.

Springs 182A and 182B can reduce this necessary downward pressure to the extend that blade 40 can "float in air", yet drop to a submerged position. A specific spring tension and arrangement achieves this result. FIGS. 11*a* and 11*b* show this arrangement in views from a forward position of the starboard mechanism, including the water surface 190. The illustrations are not actual views of the embodiment, but representations to demonstrate and amplify the typical arrangement. The letter S represents an extension spring, such as spring 182A or 182B. The letter P represents the pivot of the frame. Letter X represents the attachment point of S to the frame. The letter Y represents the attachment point of S to the mount.

In FIG. 11*a,* blade 40 extends outward, away from canoe 20 on a plane approximately horizontal. To balance at this position, blade 40 requires a "predetermined" lifting pressure. The position of points X and Y relative to P provides the specific amount of lifting pressure to balance blade 40 in this position. In FIG. 11*b,* blade 40 extends outward to a lower, immersed, or submerged position. At this position, blade 40 requires an equal, or preferably, a reduced lifting pressure. Should lifting pressure exceed the "predetermined", blade 40 would require undesirable downward pressure (applied by upward pressure on handle 32) to immerse in water. Although S extends more in FIG. 11*b* than in FIG. 11*a,* it provides reduced effectiveness in FIG. 11*b.* This is due to the change of position of points X and Y relative P in FIG. 11B. In other words, in FIG. 11*b,* S is closer to P than in FIG. 11*a,* reducing the mechanical advantage of S in FIG. 11*b.* With this arrangement, blade 40 can balance at an extended horizontal position and still drop by its own weight to a fully submerged position.

The weight and specific gravity (density) of blade 40 are factors that determine the exact location of points X and Y relative P. One spring does not require the same exact arrangement as the other. Such is the case in the actual, present embodiment. The combined arrangement of all springs in the system determine the counterbalance effect on blade 40. With this arrangement, the oarsman can effect vertical movement of blade 40 with minimal effort.

One can determine size of counterbalance springs 182A and 182B by balancing extended blade 40 to the weight of the oarsman's outstretching arm resting on handle 32. Of coarse, the exact size can deviate somewhat with the preference of the oarsman. In the immersed position, it is usually desirable that blade 40 possesses a small amount of weight. This permits blade 40 to quickly drop by its own weight to a fully immersed position. Additionally, it is easier to push down on handle 32 when close to the chest, than lift handle 32 with arm extended. When substituting oar blade lever 38 for another with a different length, springs 182A and/or 182B will also require a change to a different size to maintain the same balance.

The tension of springs 182A and 182B transfers to outriggers 30A and 30B and onward to thwarts 46 and 48. This tension ultimately converts to a downward pressure on each gunwale 22, effectively dissipating through canoe 20 without hull distortion.

FIG. 9*a* illustrates blade 40 in a submerged position in water with float 42 assuming a raised position. FIG. 9*b* illustrates blade 40 raised out of water with float 42 assuming a lower position. The attachment of blade float 42 to blade 40 further improves the performance of the apparatus. Referring to FIG. 9*a,* float 42 allows blade 40 to fully submerge in water, while preventing blade 40 from sinking lower than necessary. Rowing shells employ a positive pitch in oar blades to prevent this sinking. This pitch places the upper edge of each blade rearward relative the lower edge. This tends to lift the blades during the power stroke. Consequently, a portion of the forward thrust deflects downward. Float 42 serves this same purpose without this loss in forward thrust. Blade 40 remains at the proper submerged depth, regardless of the speed or power applied.

In this embodiment, blade 40 has a negative buoyancy in water. This is a preferred characteristic which allows blade 40 to fully submerge rapidly, without bobbing or bouncing. Also, blade 40 has a negative pitch with the upper edge slightly forward of the lower edge. This negative pitch of approximately five degrees, tends to pull blade 40 into the water during the power stroke and lift blade 40 at the release or beginning of the recovery stroke.

In FIG. 9*a,* webbing hinge straps 168 serve as a pivot or hinge, allowing float 42 to raise when blade 40 is submerged in water. In FIG. 9*b,* straps 168 allow float 42 to drop by its own weight when raised out of water. In this "dropped" position, float 42 serves to reduce aerodynamic drag of blade 40 during the recovery stroke. Lever 38 limits float 42 from dropping to a lower angle. A lower angle can impede movement to the raised position.

In addition, the oarsman can stabilize canoe 20 by applying a downward pressure to port and starboard floats 42 when extending and floating in water. This can be useful with all unstable watercraft, particularly in turbulent waters.

When the oarsman wishes to retract oar blade lever 38 along with blade 40, 180° of stroke or rotation is available. This allows blade 40 to move in close proximity of canoe 20. The oarsman has the option of rotating lever 38 to a forward or rearward position, permitting the oarsman and passengers to enter or exit without interference. In the retracted position, housing 24 tilts inboard, with its lower inboard edge stopping against rear outrigger 30A (refer to FIG. 5). Blade 40 will remain in a fully retracted position and in close proximity to the side of canoe 20 due to the following. In the retracted position, counterbalance springs 182A and 182B have ample spring tension to maintain housing 24 tilting inboard. Because blade 40 rotates on a plane tilting inboard when in this retracted position, blade 40 tends to rotate inboard to a position lower on this plane.

Should drive cables 112 require tightening or adjustment to centralize the position of handle lever 34 relative to oar blade lever 38, only a simple procedure is necessary. Removal of canopy covers 28 are necessary for access to adjusting nuts 150, which effect this adjustment. Access holes (not shown) in each canopy 26 permit a wrench easier access to nuts 150. Referring to FIG. 7, this embodiment has an adjustment on each sheave 108 and 110. Each set of nuts 150 adjusts the length of one cable only.

To adjust cables 112, handle lever 34 is rotated to a "mid-stroke" or "halfway" position between canopy brackets 114 (as shown in FIGS. 4 and 7). At this position, oar blade lever 38 should also be in a "halfway" position (also shown in FIGS. 4 and 7). Should lever 38 require an adjustment forward, nuts 150 on sheave 108 should be loosened and nuts 150 on sheave 108 tightened. Should lever 38 require adjustment to the rear, the opposite should be performed. If only the tension of cables 112 require adjusting, each set of nuts 150 should be tightened or loosened equally so as not to alter the position of one lever relative the other. When properly adjusted in this manner, 180° of rotation can be attained.

A significant feature of this embodiment is the pivot location of the frame. This pivot location, which is outboard from the inboard edge of housing 24 and inboard from axles 120, is a compromise to achieve desirable characteristics. At this location below housing 24, the pivot will not interfere with retracted oar blade lever 38. This location reduces the necessary vertical movement of handle 32 to raise blade 40 out of water. This compromised location also provides satisfactory height or clearance that oar blade 40 can be lifted above water during the recovery stroke. A pivot location further inboard would provide more of this clearance above water, but would require more counterbalance spring tension. Furthermore, this pivot location provides a desirable tilt limit to housing 24, which stops against outrigger 30A. The location of this limit prevents excessive imbalance of canoe 20 when the oarsman retracts only one blade 40 without the other.

Although not a novel feature by itself, this embodiment possesses the benefit of an elongated frame mounted longitudinally to gunwale 22. This allows a mount to be constructed lighter, and still distribute the twisting pressures to a longer and larger area of the hull.

RAMIFICATIONS, SCOPE, AND CONCLUSION

Although the foregoing description is presented as a preferred embodiment, it is not intended to limit the invention to the precise form disclosed. There are various possibilities of variations of the apparatus.

FIG. 12 shows a variation of bearing and axle arrangement and represents the same sectional view as FIG. 5. FIG. 12 does not illustrate a portion of cable 112 shown in FIG. 5. In this variation, a sheave 192 substitutes sheave 108. Sheave 192 affixes at its axial center to a sheave bearing 194 by a plurality of fasteners 196. A lever bearing 198 affixes to lever 34 by screws 134. Bearings 194 and 198 rotate on a flanged axle 200. At its flanged end, axle 200 affixes to housing 24 by a plurality of recessed fasteners 202. The opposite end of axle 200 provides a shoulder and threaded end to receive a mounting plate 204. An axle nut 206 affixes plate 204 to axle 200 by compression. Plate 204 affixes to canopy 26 by fasteners 196. As axle 200 is stationary, this variation requires a canopy cover bearing 208, which bears on a shoulder bolt 210. Bolt 210 secures to the same threaded end of axle 200. If inverted, FIG. 12 can represent the same variation in FIG. 6.

Other possible variations involve the arrangement of the axes of each sheave relative the other. FIGS. 13*a* to 13*d* show variations where the axis of handle sheave 108 have a location outboard relative the axis of oar blade sheave 110. FIG. 13*a* is a top plan view of one variation. FIG. 13*b* is an elevation view of the variation in FIG. 13*a,* viewed from a forward or rearward position. In this variation, both axes of the sheaves are within a plane perpendicular to a pivot axis 212 of a housing 214. FIG. 13*c* shows a top plan view of a variation where a housing 216 supports the axis of each sheave within a plane approximately thirty degrees to axis 212. FIG. 13*d* is an elevation view of the variation in FIG. 13*c*. FIGS. 13*b* and 13*d* can be views from either a forward or rearward position, as they can represent either the port or starboard side mechanism. Although both variations allow a longer handle lever 34, both have undesirable, wider profiles. Either variation is larger, heavier, and requires more counterbalance spring tension. Another variation (not shown) can have the axis of handle sheave 108 arranged forward and tandem of the axis of oar blade sheave 110. Other variations are possible with similar arrangements of axes within the scope of the claims.

FIG. 14 illustrates a version of the apparatus employing gears, showing canopy covers 28 removed. This gear version is identical to the sheave version, with the exception of having a pair of drive gears 218 replacing the sheaves and all the cable components. As rotation is limited to 180°, each gear 218 only requires approximately 210° of circumference. Having no spacing between gears 218, this gear version has a shorter longitudinal frame dimension than the sheave version. A shorter housing 220 substitutes housing 24. All other members of this gear version are identical to the sheave version, with the exception of different hole locations for heel bolts 136 and toe bolts 140 in levers 34 and 38. This gear version, although not a preferred embodiment, is a possible variation within the scope of the claims.

The following variations do not include illustrations, as they are relatively easy to comprehend. A possible variation includes a frame which supports both lever axes within a common plane having a slight twist. Although this variation has no significant advantage, it is within the scope of the appended claims. Although a heavier variation, thwarts 46 and/or 48 can take the form of a "cross-brace" which dips or curves downward, passing below the oarsman's legs, providing easier access or more freedom of movement. Mounting pads 54 can have a spherical upper surface instead of cylindrical. Thwarts 46 and 48 can have a cylindrical or spherical under surface above pads 54 to serve the same function. Another variation can include an oar blade sheave 110 with a smaller diameter than handle sheave 108. This can act as a "higher gear", increasing the speed of oar blade 40, without increasing the length of oar blade lever 38. This variation can impart a shorter, more comfortable stroke to the oarsman.

The oar blade can have many variations also. A less desirable, but possible variation can include an oar blade having an equal or lower density than water. In this case, the arrangement effecting the spring tension reduction (shown in FIGS. 11*a* and 11*b*) may require an adjustment to allow the oar blade to submerge rapidly. A variation can include an oar blade float which attaches to any portion of an oar appendage. An oar appendage heretofore includes a shaft, such as lever 38, and the attaching oar blade combined.

Figure 15A:
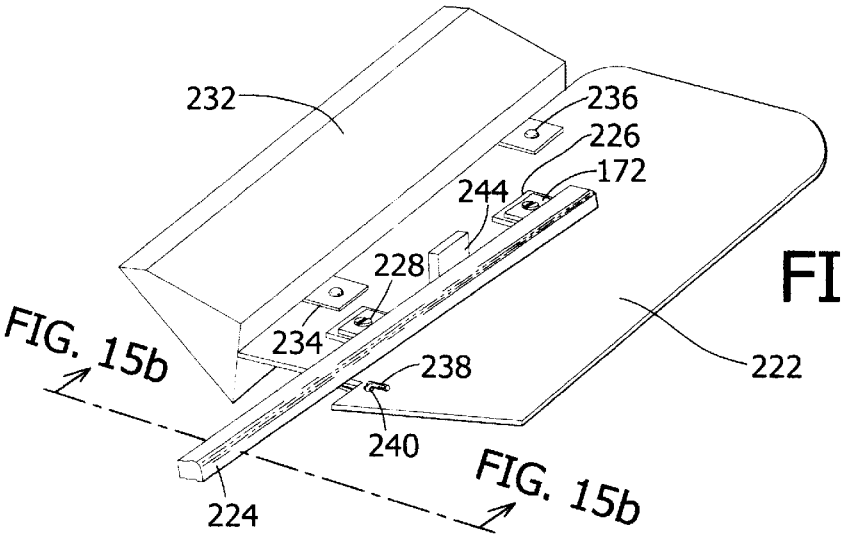
Figure 15B:
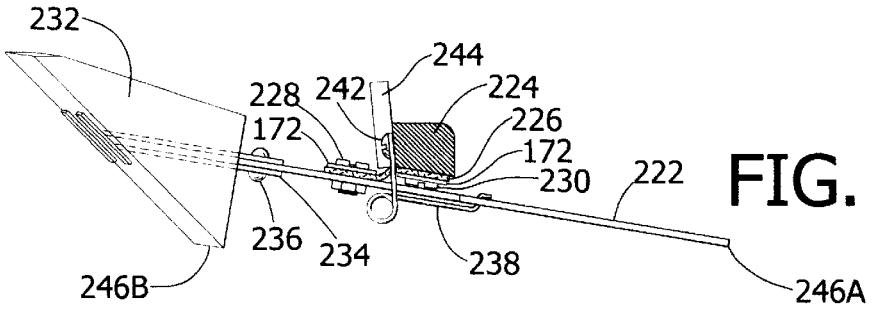
Figure 15C:
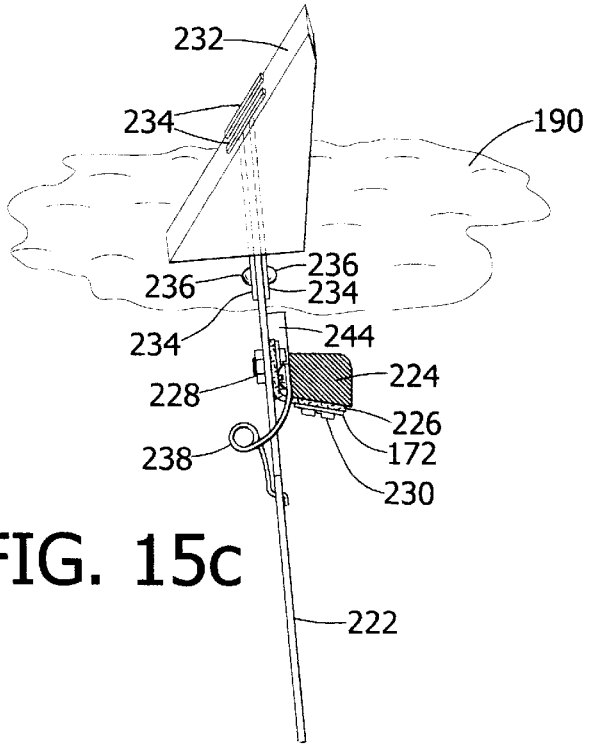
Figure 15D:
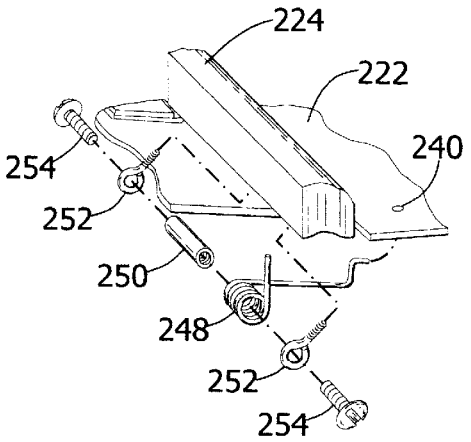

FIGS. 15*a* to 15*d* relate to a significant variation of oar blade which automatically feathers when raised out of water. FIG. 15*a* illustrates a perspective view of the starboard oar blade in a feathered position. FIG. 15*b* illustrates the same feathered position viewed from section line 15*b*. FIG. 15*c* illustrates the oar blade in a submerged position, viewed from the same position as in 15*b*. FIG. 15*d* illustrates an exploded detail of a spring with associated members. FIG. 15*d* also includes a portion of the oar blade and an attaching shaft.

Referring to FIGS. 15*a* and 15*b*, a featherable oar blade 222 attaches to an oar shaft 224 by a plurality of webbing hinges 226. Each hinge 226 comprises a flexible, flat, woven material, which functions as a joint. Being an extension of lever 38, shaft 224 pivotally secures to the power face (rearward face) of blade 222. Each hinge 226 secures at one end to blade 222 by a fastener 228. A fastener 230 secures the other end of each hinge 226 to shaft 224. Rectangular washer 172 sandwiches between fastener 228 and hinge 226. Likewise, another washer 172 sandwiches between fastener 230 and hinge 226. Each washer 172 compresses hinge 226 to blade 222 or shaft 224, while forming pivotal edges. A hydroplane float 232 rigidly secures to blade 222 by a plurality of rigid float anchors 234. In this embodiment, each anchor 234 includes a flat plate, which conforms with the forward surface of float 232 (FIGS. 15*b* and 15*c*). From this plate, anchor 234 extends through float 232, forming a rigid tab on each side of blade 222. Both tabs secure to opposite surfaces of blade 222 by a fastener 236. In this way, float 232 attaches with rigidity to blade 222.

In FIGS. 15*a* and 15*b*, spring tension of a torsion spring 238 maintains blade 222 in the feathered position. One end of spring 238 extends through a hole 240 in blade 222. Hole 240 maintains position of this end of spring 238. At this end of spring 238, upward spring tension transfers to blade 222. The opposite end of spring 238 attaches to shaft 224 by a fastener 242. Spring tension transfers to shaft 224 at this opposite end.

In FIG. 15*c*, the buoyancy of float 232 overcomes the spring tension of spring 238. A blade stop 244, which is rigidly attached to shaft 224, limits the angle of blade 222 to approximately five degrees before vertical. This angle causes blade 222 to "dig" or tend to pull into the water during the power stroke. Blade 222 has a pivotal axis location closer to its upper edge (which attaches to float 232) than to its lower edge. During the power stroke, this location distributes more water pressure to blade 222 below the pivotal axis than above. This unequal pressure assists in maintaining blade 222 in the vertical position. At the "release", or end of the power stroke, blade 222 resumes the feathered position when removed above water surface 190.

In FIG. 15*b*, an angled lower surface of shaft 224 limits blade 222 to a predetermined angle. This angled surface imparts an angled, under surface to blade 222, with its forward edge (which attaches to float 232) higher than its rear edge 246A. Likewise, float 232 possesses an angled under surface with its forward edge higher than its rear, lower edge 246B. These under surfaces of blade 222 and float 232 function as hydroplane surfaces. When moving in a forward direction on water, they provide a lifting force to float 232 and blade 222. This feature allows float 232 and blade 222 to hydroplane if accidentally contacting the water surface (not shown in FIG. 15*b*) during the recovery stroke. Because edges 246A and 246B are the lowest points of each under surface, they function as "hydroplane" edges. Each edge 246A and 246B possesses a sharp edge, reducing drag to a minimum. This hydroplane action also assists in lifting blade 222 at the beginning of the recovery stroke.

Assisting the oarsman lift blade 222 during the recovery stroke, the forward, lower surface of float 232 produces a small amount of aerodynamic lift.

At the beginning of the power stroke, edge 246A "catches and digs" into the water surface, assisting the rotation of blade 222 to the submerged position.

FIGS. 15*b* and 15*c* primarily intend to illustrate the action of spring 238, showing its coil at a lower than desirable position. This is not to obstruct the view of hinge 226 and other members. A more desirable position of the coil is at the axis of the pivot of hinge 226. FIG. 15*d* illustrates a more desirable spring arrangement. An alternate torsion spring 248 substitutes spring 238. In this arrangement, the coil of spring 248 has a location along the axis of the pivot of hinge 226. A mandrel 250 supports the coil of spring 248. A screw eye 252, secures to each opposite end of mandrel 250 by an end fastener 254. Each eye 252 secures to shaft 224. This arrangement eliminates the need for fastener 242.

This feathering blade variation has various advantages over prior art. Primarily, past designs either require rotation or horizontal movement of the handle to rotate the blade. None are capable of automatic rotation when moving in or out of water. The present blade variation possesses this ability, irrespective of the position in the stroke. With this ability, it can function when rowing backwards (pushing on handle). Although this feathering variation will operate in a variety of conditions, it performs best in flat water. For white water, where maneuverability is the primary desire, the variation shown in FIGS. 9*a* and 9*b* performs better.

Other similar variations of this feathering blade are also possible. For example, such variations can include a single hinge or single float anchor substituting hinges 226 and anchors 234 respectively. The oar blade can have its pivotal axis on the opposite side of the blade. The shaft can be tubular with the pivotal axis coinciding with its longitudinal axis. The shaft can rigidly attach to the oar blade, having a hinge or joint inboard, relative the blade. Lastly, all oar blade variations described herein can obviously attach to conventional, non-articulated oars.

The above mentioned variations are only examples of a few embodiments possible. Combinations of the variations are also possible. Consequently, the scope of the invention should be determined by the appended claims and their legal equivalents, rather than the examples given.

In light of the foregoing discussion, it becomes apparent that my present invention of rowing apparatus accomplishes all the previously mentioned objects. Although a few prior art designs may share a couple of the advantages of my present invention, all prior art possess numerous disadvantages. With its unique and novel design, my present invention corrects all these disadvantages for the first time ever.

What is claimed is defined as follows:

1. A rowing apparatus for a boat having a forward to rearward longitudinal axis, said apparatus comprising:

a frame adapted to be pivotally supported from a mount attached to said boat;

a first rotary energy conveying component, which has a first periphery and is rotatable about a first axis oriented substantially vertical, said first axis having a first upper end section and a first lower end section;

a first lever rigidly connecting to and disposed above said first component, extending outward beyond said first periphery;

said frame adapted to support said first axis at predetermined areas above and below said first component;

a second rotary energy conveying component in juxtaposition to said first component, having a second periphery and being rotatable about a second axis generally parallel to said first axis, said second axis having a second upper end section and a second lower end section;

a second lever rigidly connecting to and disposed under said second component, extending outward beyond said second periphery;

said frame adapted to support said second axis at predetermined areas above and below said second component;

at least one said component substantially attached to its concomitant said lever;

handle means coupled to said first lever;

an oar blade coupled to said second lever;

drive means engaging said components in a manner wherein said first and said second components rotate simultaneously in opposite rotational directions; and said components arranged in a manner wherein rearward and forward movement of said handle means, relative to said boat, causes a rearward and forward movement, respectively, of said oar blade, relative to said boat.

2. The frame as set forth in claim 1 further including:

an upper portion rigidly attached to a lower portion, said upper portion having an opening of sufficient size as to allow said first lever to exit and rotate about said first axis, said upper portion adapted to support said second upper end section, said lower portion adapted to support said first lower end section; and a structure adapted to support said first upper end section at a location intersecting a predetermined horizontal plane spaced substantially above said upper portion, said structure being rigidly attached to said upper portion.

3. The frame as set forth in claim 1 further including:

an upper portion rigidly attached to a lower portion, said lower portion having an opening of sufficient size as to allow said second lever to exit and rotate about said second axis, said lower portion adapted to support said first lower end section, said upper portion adapted to support said second upper end section; and a structure adapted to support said second lower end section at a location intersecting a predetermined horizontal plane spaced substantially below said lower portion, said structure being rigidly attached to said lower portion.

4. The rowing apparatus as set forth in claim 1 wherein:

at least one said component is affixed to an axle having opposite end portions coincident with concomitant said axis;

said frame has upper and lower axle support means adapted to rotatably support said opposite end portions;

said upper axle support means is rigidly connected to said lower axle support means; and at least a portion of at least one said lever is disposed between its concomitant said component and a predetermined horizontal plane which intersects an axial support location of said concomitant component.

5. The rowing apparatus as set forth in claim 1 wherein:

at least one said component is rotatably mounted to an axle having opposite end portions, coincident with concomitant said axis;

said frame has upper and lower axle support means adapted to support said opposite end portions.

said upper axle support means is rigidly connected to said lower axle support means;

at least a portion of at least one said lever is disposed between its concomitant said component and a predetermined horizontal plane which intersects an axial support location of said concomitant component.

6. The rowing apparatus as set forth in claim 1 wherein:

said axes of said components are arranged substantially equal distant from said longitudinal axis of said boat, one said component aft of other said component.

7. The rowing apparatus as set forth in claim 1 wherein;

said axes of said components are arranged at substantially different distances from said longitudinal axis of said boat.

8. The rowing apparatus as set forth in claim 1 wherein:

at least one said lever extends outward on a predetermined axis within thirty degrees relative to a plane perpendicular to said axis of its concomitant said component;

said rotary energy conveying components have been selected from the group consisting of sheaves, sprockets, and pulleys; and said drive means has been selected from the group consisting of chains, belts, cables, and flexible force transmitting members.

9. The rowing apparatus as se forth in claim 1 wherein:

at least one said lever extends outward on a predetermined axis within thirty degrees relative to a plane perpendicular to said axis of its concomitant said component;

said rotary energy conveying components are gears having teeth; and said drive means are said teeth of said gears.

10. A rowing apparatus for a boat having a forward to rearward longitudinal axis and oriented in an operational position, said apparatus comprising:

a handle;

an oar blade;

transmission means, coupling said handle to said oar blade in an articulated manner wherein rearward and forward movement of said handle, relative to said boat, causes said rearward and forward movement of said oar blade, respectively, relative to said boat;

said transmission means being adapted to be pivotally attached to said boat about a pivotal axis approximately horizontal and within forty five degrees parallel to said longitudinal axis; and a device having a first locus and a second locus with elastic tension between said loci, said device being arranged in such a way as to apply a lifting pressure to said oar blade, relative to said boat, about said pivotal axis.

11. The rowing apparatus as set forth in claim 10 wherein:

said device has been selected from the group consisting of springs, pneumatic springs, gas springs, and elastic cords.

12. The rowing apparatus as set forth in claim 11 wherein:

said first locus, said second locus, and said pivotal axis are arranged in a manner which provides said device with a predetermined amount of mechanical advantage when said oar blade is in a first position, defined as when said oar blade extends substantial perpendicular to said pivotal axis and intersects a substantially horizontal axis, which intersects said pivotal axis; and said first locus, said second locus, and said pivotal axis are arranged in a manner which provides said device with a reduced amount of mechanical advantage, relative to said predetermined amount, when said oar blade extends substantially perpendicular to said pivotal axis and is in a submerged, lower position, relative to said first position, whereby permitting a balanced, weightless condition of said oar blade in an extended, horizontal position, while preventing excessive lifting pressure in said submerged position.

13. The rowing apparatus as set forth in claim 11 wherein:

said transmission means includes a frame pivotally supported about said pivotal axis from a mount adapted to attach to said boat; and said first locus is attached to a third locus substantially rigid with said boat and said second locus is attached to a forth locus substantially rigid with said frame.

14. The rowing apparatus as set forth in claim 13 wherein:

said oar blade is arranged to rotate along a tilted plane which is higher outboard than inboard, relative said boat, when said frame is in a withdrawn position; and said device is arranged to provide a predetermined spring tension which maintains said frame in said withdrawn position when said blade is in a retracted position of substantially close proximity of said boat, whereby maintaining said blade in said retracted position by gravity.

15. The rowing apparatus as set forth in claim 13 wherein:

said first locus is attached to said mount; and said mount is attached to a member adapted to span athwart said boat whereby said elastic tension is transferred to said member.

16. The rowing apparatus as set forth in claim 10 wherein said boat has a gunwale and said apparatus further includes:

a member adapted to span athwart said boat;

a support pad adapted to be attached to an upper surface of said gunwale with a suitable adhesive and demountably attached to an under surface of said member, said member and said pad adapted to maintain a predetermined resting area of said member over said gunwale, irrespective of a variation in slope of said upper surface, whereby being adaptable to different gunwales; and keying means for substantially preventing horizontal movement of said member relative said pad.

17. The rowing apparatus as set forth in claim 10 wherein:

said boat has port and starboard gunwales;

said apparatus includes a pair of thwarts adapted to span and be attached to said gunwales, one said thwart being disposed aft of other said thwart; and said apparatus also includes a brace arranged in such a way as to substantially maintain a predetermined distance between a port side end of one said thwart and a starboard side end of other said thwart.

18. The rowing apparatus as set forth in claim 10 wherein:

said transmission means includes a handle lever which is attached to said handle; and said handle projects from said handle lever on an upward angle relative to said handle lever when said handle lever is oriented horizontally.

19. The handle as set forth in claim 18 wherein:

said handle comprises two projections adjoining in a manner forming an obtuse-angled shape; and a longitudinal surface of one said projection is adapted to be attached to a longitudinal surface of said handle lever.

20. The rowing apparatus as set forth in claim 10 further including a pennant bumper for deflecting obstacles around said apparatus, said pennant bumper comprising:

a triangular, flaglike structure adapted to be attached to said boat at least 12 inches forward of said transmission means and to said transmission means at a predetermined area sufficiently outboard of said boat for effective deflection of said obstacles.

21. A rowing apparatus for a boat having a forward to rearward longitudinal axis and oriented in an operational position, said apparatus comprising:

handle means;

an oar appendage defined as a shaft attached to an oar blade;

coupling means engaging said handle means to said oar blade in a manner wherein longitudinal movement of said handle means, relative to said boat, causes longitudinal movement of said oar blade relative to said boat;

said handle means, said oar appendage, and said coupling means adapted to connect to said boat in such a way as to transfer forward thrust to said boat, relative to said longitudinal axis; and an oar blade float comprising a component with a density less than water, for limiting depth of submergence of said oar blade in water, said float being attached to said oar appendage in such a way as to be maintained substantially above said oar blade when said oar blade is oriented in an operational position and submerged in water.

22. The rowing apparatus as set forth in claim 21 wherein:

said float is accommodated with a pivotal attachment to said appendage, allowing said float to move to a lower position, relative to said oar blade, when said oar blade is removed from water and oriented in an operational position, whereby reducing aerodynamic drag of said blade.

23. The rowing apparatus as set forth in claim 21 further including:

a pivot, arranged in such a way as to allow said blade to rotate to a feathered position; and a device, such as a spring, which provides elastic tension, arranged in such a way as to maintain said blade in said feathered position when said blade is removed from water, said device having a predetermined tension allowing the buoyancy of said float to rotate said blade to an approximately vertical plane when said blade is fully immersed in water and oriented in an operational position.

24. The rowing apparatus as set forth in claim 23 wherein:

said float has a hydroplane surface for producing lift on a water surface when said blade is in said feathered position and moving in a forward direction.

* * * * *